US010906767B2

(12) United States Patent
Mizutani

(10) Patent No.: US 10,906,767 B2
(45) **Date of Patent: *Feb. 2, 2021**

(54) SHEET BINDING DEVICE AND SHEET BINDING METHOD

(71) Applicants: KABUSHIKI KAISHA TOSHIBA, Tokyo (JP); TOSHIBA TEC KABUSHIKI KAISHA, Tokyo (JP)

(72) Inventor: Kikuo Mizutani, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 110 days.

This patent is subject to a terminal disclaimer.

(21) Appl. No.: 16/241,054

(22) Filed: Jan. 7, 2019

(65) Prior Publication Data

US 2019/0135571 A1 May 9, 2019

Related U.S. Application Data

(63) Continuation of application No. 15/277,767, filed on Sep. 27, 2016, now Pat. No. 10,202,252.

(51) Int. Cl.
*G03G 15/00* (2006.01)
*B42C 9/00* (2006.01)
(Continued)

(52) U.S. Cl.
CPC ..... *B65H 43/00* (2013.01); *B42C 9/0068* (2013.01); *B42C 9/0075* (2013.01); *B65H 26/06* (2013.01); *B65H 29/12* (2013.01); *B65H 35/0006* (2013.01); *B65H 35/0066* (2013.01); *B65H 37/04* (2013.01); *G03G 15/6544* (2013.01); *G03G 15/6547* (2013.01);
(Continued)

(58) Field of Classification Search
CPC ..... B42B 5/04; G03G 2215/00873; G03G 2215/00839; G03G 15/00839; G03G 15/00873; B65H 2301/43821; B42C 9/0075; B42C 9/0068
See application file for complete search history.

(56) References Cited

U.S. PATENT DOCUMENTS 3,920,501 A 11/1975 Carlton et al.
5,980,676 A 11/1999 Meetze
(Continued)

FOREIGN PATENT DOCUMENTS

EP 3263356 A1 1/2018
JP H07-304279 A 11/1995
JP 2015-048198 A 3/2015

OTHER PUBLICATIONS

Extended European Search Report dated Feb. 23, 2018, mailed in counterpart European Application No. 17192599.3, 8 pages.

*Primary Examiner* — Jennifer E Simmons
(74) *Attorney, Agent, or Firm* — Kim & Stewart LLP

(57) ABSTRACT

A sheet binding device includes a sheet shifting unit, a tape cutter, and a tape attachment unit. The sheet shifting unit has a guide and is configured to stack multiple sheets on the guide with edge portions that are shifted from each other to form a sheet bundle. The tape cutter cuts tape with a target length that is varied in accordance with a thickness of the sheet bundle. The tape attachment unit is configured to attach the cut tape having the target length to an edge portion of the sheet bundle.

20 Claims, 20 Drawing Sheets

(51) Int. Cl.

| | |
|---|---|
| ***B65H 43/00*** | (2006.01) |
| ***B65H 35/00*** | (2006.01) |
| ***B65H 37/04*** | (2006.01) |
| ***B65H 29/12*** | (2006.01) |
| ***B65H 26/06*** | (2006.01) |

(52) U.S. Cl.

CPC ..... *B65H 2301/43821* (2013.01); *B65H 2301/515* (2013.01); *B65H 2301/51122* (2013.01); *B65H 2511/11* (2013.01); *B65H 2801/27* (2013.01); *G03G 2215/00839* (2013.01); *G03G 2215/00848* (2013.01); *G03G 2215/00873* (2013.01)

(56) References Cited

U.S. PATENT DOCUMENTS

| | | | | |
|---|---|---|---|---|
| 6,000,894 | A | 12/1999 | Suzuki et al. | |
| 6,732,777 | B2 | 5/2004 | Ertel et al. | |
| 8,393,372 | B2 | 3/2013 | Yamauchi et al. | |
| 10,053,326 | B2 | 8/2018 | Sasahara | |
| 2016/0176217 | A1* | 6/2016 | Mueller ..... | B42C 9/0075 412/6 |

* cited by examiner

SHEET BINDING DEVICE AND SHEET BINDING METHOD

CROSS-REFERENCE TO RELATED APPLICATION

This application is a continuation of U.S. patent application Ser. No. 15/277,767, filed on Sep. 27, 2016, the entire contents of each of which are incorporated herein by reference.

FIELD

Embodiments described herein relate generally to a sheet binding device and a sheet binding method.

BACKGROUND

A sheet binding device causes a stapler to bind an edge portion of a sheet bundle.

For the sheet binding device, it is desirable to reduce the amount of consumables used and the cost for replenishment.

DETAILED DESCRIPTION

Figure 1:
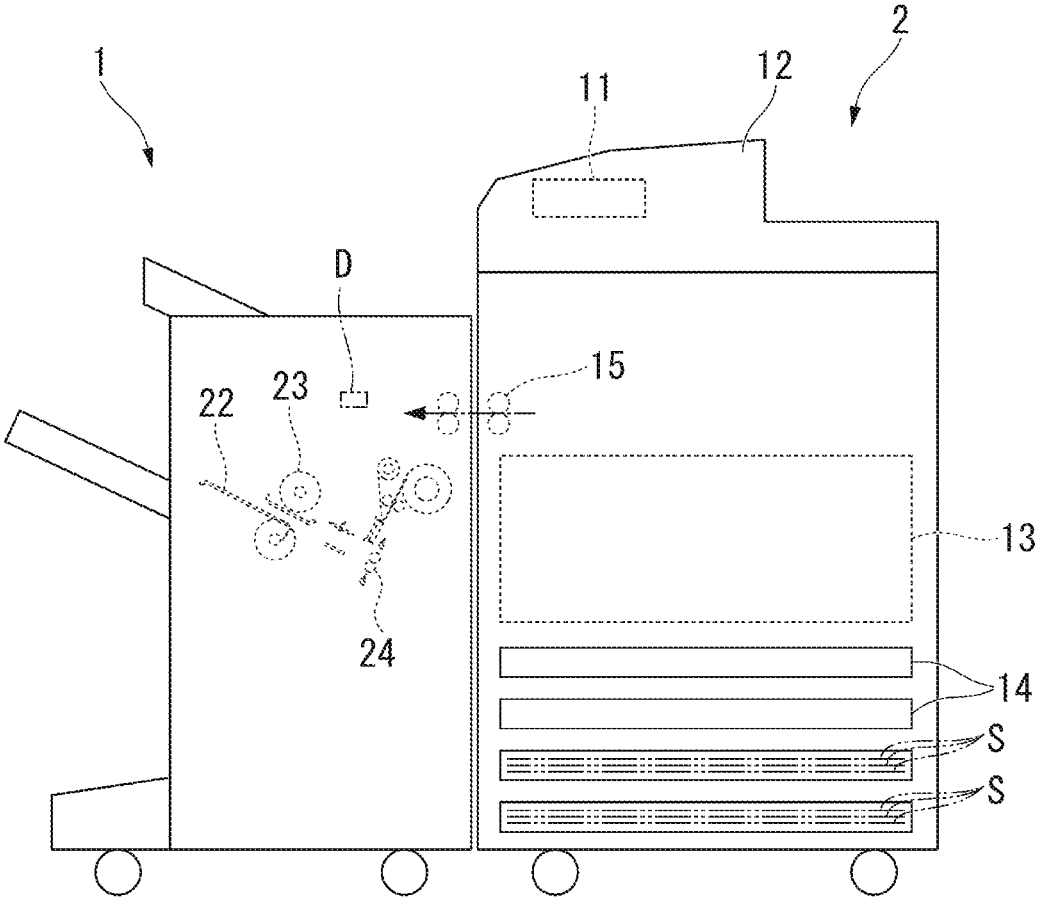
FIG. 1 is a front view illustrating a sheet binding device according to a first embodiment and an image forming apparatus.

According to an embodiment, a sheet binding device includes a sheet shifting unit, a tape cutter, and a tape attachment unit. The sheet shifting unit has a guide and is configured to stack multiple sheets on the guide with edge portions that are shifted from each other to form a sheet bundle. The tape cutter cuts a tape with a target length that is varied in accordance with a thickness of the sheet bundle. The tape attachment unit is configured to attach the cut tape having the target length to an edge portion of the sheet bundle.

Hereinafter, the sheet binding device and a sheet binding method according to embodiments will be described with reference to the drawings. In the following description, the same reference numerals will be given to configurations having the same or similar function. In some cases, repeated description of the configurations may be omitted. In this application, various sheet-like media including papers are referred to as "sheets".

First Embodiment

A first embodiment will be described with reference to FIGS. 1 to 17.

Figure 2:
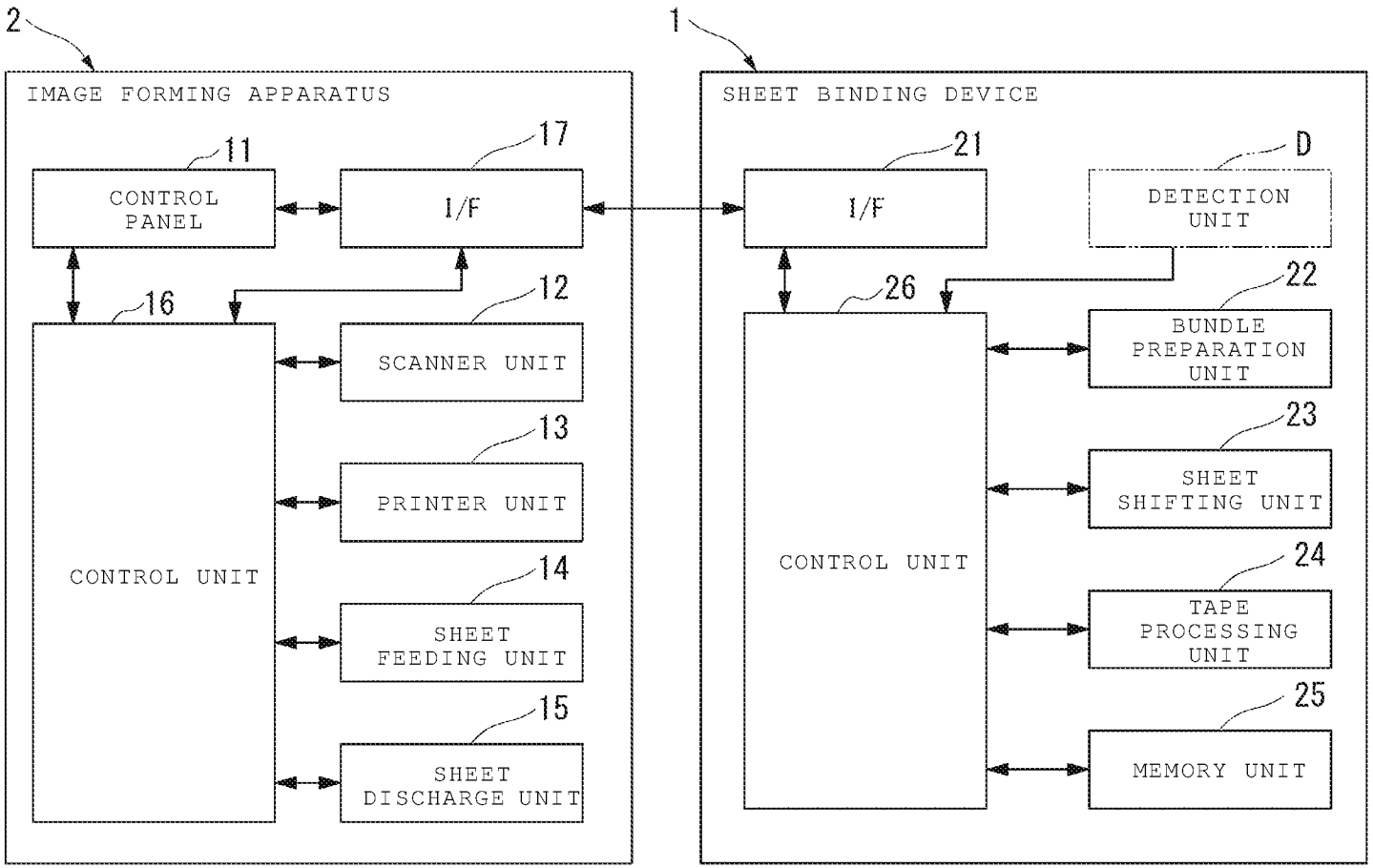
FIG. 2 is a block diagram illustrating a system configuration of the sheet binding device and the image forming apparatus.

FIG. 1 is a front view illustrating a sheet binding device (sheet processing device) 1 according to the first embodiment. FIG. 2 is a block diagram illustrating a system configuration of the sheet binding device 1 according to the first embodiment. The sheet binding device 1 according to the present embodiment binds an edge portion 5*a* of a sheet bundle 5 by using a tape T (refer to FIG. 17). For example, the sheet binding device 1 is a post-processing device which is arranged in the vicinity of an image forming apparatus 2 so as to perform post-processing on a sheet S conveyed from the image forming apparatus 2. Without being limited to the above-described example, the sheet binding device 1 may be used by itself after being installed on a table or a floor, for example.

First, the image forming apparatus 2 will be briefly described.

As illustrated in FIGS. 1 and 2, the image forming apparatus 2 includes a control panel 11, a scanner unit 12, a printer unit 13, a sheet feeding unit 14, a sheet discharge unit 15, a control unit 16, and an interface 17. The control panel 11 includes various keys, and receives a user's operation. The scanner unit 12 reads a scanning target and generates corresponding image data. The printer unit 13 forms an image on a sheet S, based on the image data received from the scanner unit 12 or an external device. The sheet feeding unit 14 feeds the sheet S to the printer unit 13. The sheet discharge unit 15 conveys the sheet S discharged from the printer unit 13 to the sheet binding device 1. The control unit 16 controls various operations of the scanner unit 12, the printer unit 13, the sheet feeding unit 14, the sheet discharge unit 15, and the interface 17.

The interface 17 is connected to an interface 21 of the sheet binding device 1 in a wired or wireless manner. The image forming apparatus 2 transmits information relating to the sheet bundle 5 formed by the sheets discharged from the image forming apparatus 2, to the sheet binding device 1 through the interface 17. For example, the "information relating to the sheet bundle 5" includes at least any one of: the number of sheets S bound as one sheet bundle 5 (that is, the number of sheets S forming one sheet bundle 5), a thickness of the sheet bundle 5, and information for each sheet S. That is, the "information relating to the sheet bundle 5" may be information of the sheet bundle 5, or may be information relating to the sheet S by itself. The information relating to the sheet S by itself includes at least any one of: the thickness of the sheet S, an orientation of the sheets S, and type (material) of the sheet S.

Next, the sheet binding device 1 will be described.

As illustrated in FIG. 2, the sheet binding device 1 includes the interface 21, a bundle preparation unit 22, a sheet shifting unit 23, a tape processing unit 24, a memory unit 25, and a control unit 26.

The interface 21 receives the above-described information relating to the sheet bundle 5. For example, the interface 21 receives the information relating to the sheet bundle 5 from the image forming apparatus 2 serving as an external apparatus. In the embodiment described herein, the information relating to the sheet bundle 5 may be acquired through the interface 21 as the number of sheets S forming the sheet bundle 5. In addition, the information relating to the sheet S may be acquired as the information relating to the sheet bundle 5. In such a case, the information of the sheet bundle 5 is derived from the acquired information relating to the sheet S. The term "based on the information relating to the sheet bundle 5 that is acquired" is not limited to a case that is based on information which is directly acquired. The term also includes a case that is based on information derived from information which is directly acquired.

Next, the bundle preparation unit 22 will be described.

Figure 3:
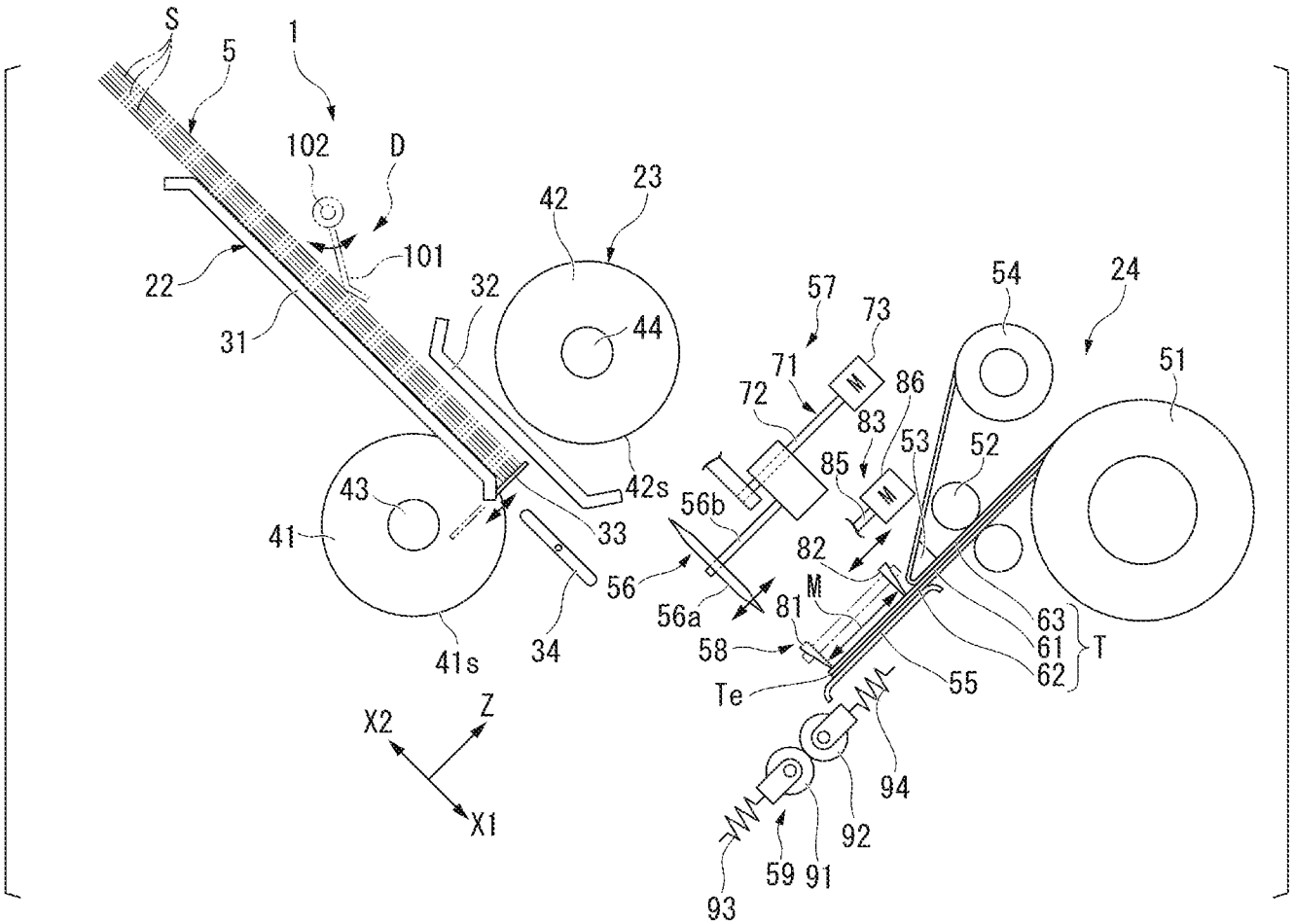
FIG. 3 is a front view illustrating an internal configuration of the sheet binding device.

FIG. 3 is a front view illustrating an internal configuration of the sheet binding device 1.

As illustrated in FIG. 3, the bundle preparation unit 22 stacks multiple sheets S on top of one another, thereby preparing the sheet bundle 5. The bundle preparation unit 22 includes a main guide 31, a sub-guide 32, a stopper 33, and a switching member 34.

The main guide 31 guides the sheet S along a sheet conveying direction X1. The multiple sheets S are sequentially stacked on the main guide 31, thereby forming the sheet bundle 5.

The sub-guide 32 faces the main guide 31 in a thickness direction Z of the sheet bundle 5 (hereinafter, referred to as a sheet bundle thickness direction). A space for stacking the sheets S is arranged between the main guide 31 and the sub-guide 32.

The stopper 33 is arranged in a downstream end portion of the main guide 31 in the sheet conveying direction X1. The stopper 33 is movable between a regulating position (illustrated by a solid line in FIG. 3) and a releasing position (illustrated by a two-dot chain line in FIG. 3) by a movement mechanism (not illustrated). At the regulating position, the stopper 33 protrudes upward from an upper surface of the main guide 31. At the regulating position, an end portion of the sheet S comes into contact with the stopper 33, thereby causing the stopper 33 to block the sheet S. Therefore, the sheets S are accumulated on the main guide 31, thereby forming the sheet bundle 5. At the releasing position, the stopper 33 is retracted downward from the upper surface of the main guide 31. At the releasing position, the stopper 33 moves out of the way so the sheet bundle 5 on the main guide 31 can move toward the switching member 34 by gravity.

The switching member 34 switches conveying paths of the sheet bundle 5. Hereinafter, a direction in which the sheet bundle 5 is conveyed toward the tape processing unit 24 (specifically, the tape attachment unit 59 to be described later) is referred to as a "first conveying direction". A direction in which the sheet bundle 5 is conveyed toward a position different from the tape attachment unit 59 (for example, downward from the bundle preparation unit 22) is referred to as a "second conveying direction. The switching member 34 switches the conveying paths of the sheet bundle 5 between the first conveying direction and the second conveying direction.

Next, the sheet shifting unit 23 will be described.

The sheet shifting unit 23 sequentially shifts the multiple sheets S little by little in the sheet conveying direction X1, thereby forming a state where the multiple sheets S forming the sheet bundle 5 are shifted in the edge portion 5*a*. For example, the sheet shifting unit 23 forms a state of the sheet bundle 5 where the multiple sheets S are shifted in the edge portion 5*a* in a stepwise manner.

Figure 4A:
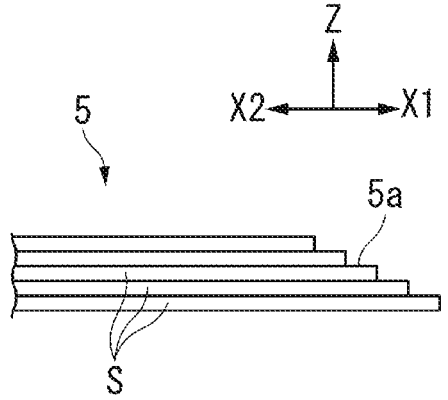
FIGS. 4A and 4B are side views illustrating a state where multiple sheets are shifted in an edge portion of a sheet bundle.
Figure 4B:
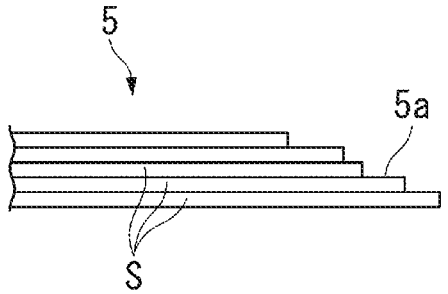

FIGS. 4A and 4B are side views illustrating a state where the multiple sheets S are shifted in the edge portion 5*a* of the sheet bundle 5. As illustrated in FIGS. 4A and 4B, the "state where the multiple sheets S forming the sheet bundle 5 are shifted from each other in the edge portion 5*a*" described in this application means a state where the multiple sheets S are stacked while being shifted slightly in the sheet conveying direction from each other. In other words, the state means a state where stacked edge portions of the multiple sheets S are shifted from each other and the edge portions of the sheets S forming the sheet bundle 5 has a step difference. Furthermore, in other words, the state means that the multiple sheets S are partially stacked in a stepwise manner. For example, the "state where the multiple sheets S forming the sheet bundle 5 are shifted in the edge portion 5*a* in the stepwise manner" described in this application means a state where a protruding amount of the sheets S in the sheet conveying direction X1 gradually increases (or gradually decreases) in the stacked order of the multiple sheets S. Without being limited to a state where the multiple sheets S are substantially evenly shifted from each other (refer to FIG. 4A), the state may include a state where the multiple sheets S are unevenly shifted from each other (refer to FIG. 4B).

As illustrated in FIG. 3, in order to form these states, the sheet shifting unit 23 according to the embodiment described herein includes a first roller 41 and a second roller 42. The first roller 41 is an example of a "first contact member". The second roller 42 is an example of a "second contact member".

The first roller 41 is attached to a first shaft 43. The first roller 41 functions as a driving roller driven by a motor (not illustrated) via the first shaft 43. The first roller 41 is fixed at a stationary position. A material of the first roller 41 is not particularly limited. For example, the first roller 41 is formed of ethylene-propylene-diene rubber (EPDM).

The second roller 42 is attached to a second shaft 44. For example, the second roller 42 functions as a driven roller rotated in accordance with the rotation of the first roller 41. The second roller 42 is movable in a direction approaching the first roller 41 and in a direction away from the first roller 41 by a movement mechanism (not illustrated). The second roller 42 moves toward the first roller 41, thereby coming into contact with the sheet bundle 5 from a side opposite to the first roller 41.

Figure 5:
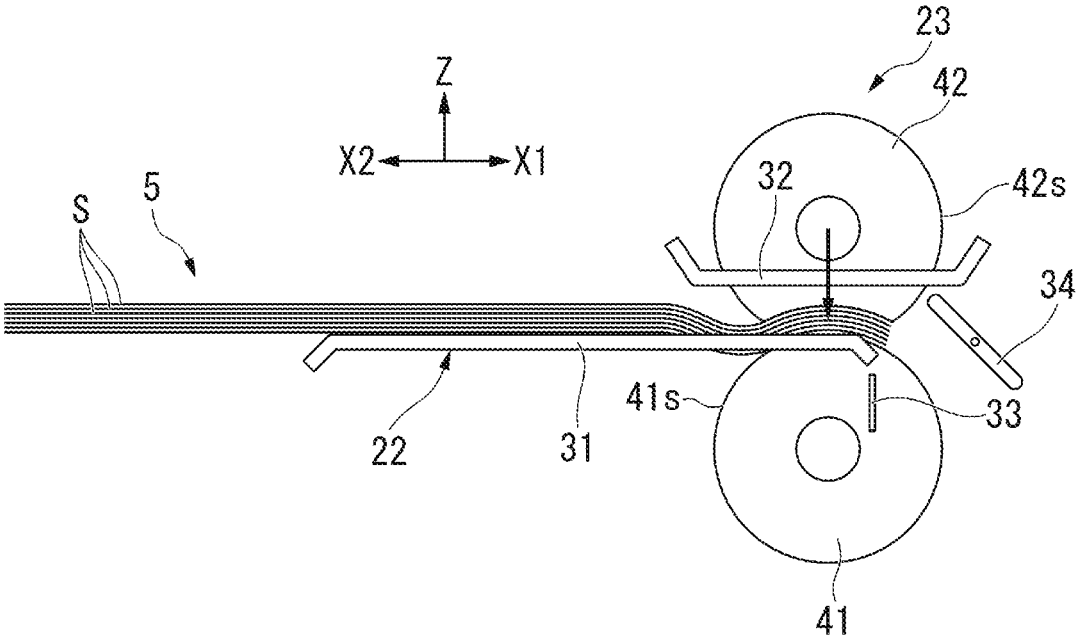
FIGS. 5 and 6 illustrate an operation of a sheet shifting unit of the sheet binding device.

Here, an outer peripheral surface 42*s* of the second roller 42 is softer than an outer peripheral surface 41*s* of the first roller 41, and is deformable along an upper surface of the sheet bundle 5 (refer to FIG. 5). For example, the second roller 42 is formed of a sponge or rubber having an interior cavity. If the second roller 42 is moved towards the first roller 41, the outer peripheral surface 42*s* of the second roller 42 is deformed in an arc shape conforming to the shape of the outer peripheral surface 41*s* of the first roller 41, together with the sheet bundle 5. In this state, the first roller 41 is driven, thereby forming a state where the multiple sheets S are shifted in the edge portion 5*a* of the sheet bundle 5 in the stepwise manner. This principle will be described in detail later.

Next, the tape processing unit 24 will be described.

As illustrated in FIG. 3, the tape processing unit 24 includes an unwinding unit 51, a tape conveying unit 52, a separation member 53, a winding unit 54, a guide base 55, a cutter 56, a cutting length changing unit 57, a tape holding unit 58, and a tape attachment unit 59.

The unwinding unit 51 is an example of a "tape supply unit". For example, the unwinding unit 51 holds an original roll around which a strip-like tape T (hereinafter, simply referred to as a "tape T") is wound. The unwinding unit 51 supplies the tape T along a longitudinal direction of the tape T. In a state where the tape T is accommodated in the unwinding unit 51, the tape T includes an adhesive layer 61, a protection film (first film) 62, and a release film (second film) 63. The protection film 62 covers the adhesive layer 61 from one side. The protection film 62 is integrated with the adhesive layer 61 when the tape T is used. The release film 63 covers the adhesive layer 61 from a side opposite to the protection film 62. The release film 63 is released from the adhesive layer 61 when the tape T is used. The release film 63 is guided around the separation member 53 and wound by the winding unit 54.

The tape conveying unit 52 conveys the tape T supplied from the unwinding unit 51, along the longitudinal direction of the tape T. For example, the longitudinal direction of the tape T is a direction which is substantially parallel to the sheet bundle thickness direction Z.

The guide base 55 guides the tape T from which the release film 63 is separated. The guide base 55 supports the tape T when the tape T is held and cut.

The cutter 56 cuts the strip-like tape T supplied from the unwinding unit 51 to form the tape T having a sheet shape. For example, the cutter 56 is a rotary cutter, and includes a cutting blade 56*a* and a support shaft 56*b*. The support shaft 56*b* is rotated by a motor (not illustrated), thereby rotatably driving the cutting blade 56*a*. A configuration of the cutter 56 is not limited to the above-described example. As long as the tape T supplied from the unwinding unit 51 can be cut according to the configuration of the cutter 56, any configuration may be adopted. The cutter 56 is movable in the direction approaching the tape T and in the direction away from the tape T by a movement mechanism (not illustrated).

The cutting length changing unit 57 changes a length L (refer to FIG. 14) of the tape T to be cut by the cutter 56. The "length of the tape" described herein is the length (width) of the tape T in the sheet bundle thickness direction Z. In other words, the "length of the tape" is the length in a direction including the edge portion 5*a* of the sheet bundle 5 from a first surface 7*a* toward a second surface 7*b* of the sheet bundle 5 (to be described later).

The cutting length changing unit 57 has a movement mechanism 71 which changes a relative position of the cutter 56 with respect to a tip end Te of the tape T supplied from the unwinding unit 51. For example, the movement mechanism 71 moves the cutter 56, thereby changing the relative position of the cutter 56 with respect to the tip end Te of the tape T. For example, the movement mechanism 71 moves the cutter 56 along the sheet bundle thickness direction Z. The "relative position of the cutter 56 with respect to the tip end Te of the tape T" represents a relative position of the cutter 56 with respect to the tip end Te of the tape T when the tape T is cut by the cutter 56, for example.

In the embodiment described herein, the movement mechanism 71 includes a support member 72 which supports the cutter 56, and a drive source 73 which moves the cutter 56 via the support member 72. For example, the support member 72 is a ball spring connected to the cutter 56. The drive source 73 is a motor which moves the cutter 56 by driving the ball spring. A configuration of the support member 72 and the drive source 73 is not limited to the above-described example. For example, the support member 72 may be a cam which is in contact with the cutter 56. The drive source 73 may be a solenoid which moves the cutter 56 via the support member 72. In such a case, the support member 72 is a connection member which connects the cutter 56 and the solenoid.

A configuration of the movement mechanism 71 is not limited to the above-described example. For example, the movement mechanism 71 may change the relative position of the cutter 56 with respect to the tip end Te of the tape T by changing the feeding length of the tape T with respect to the cutter 56 fixed at the stationary position. The configuration in this case will be described later.

In the embodiment described herein, the cutting length changing unit 57 is controlled by the control unit 26 (to be described later). For example, the control unit 26 controls the drive source 73 of the cutting length changing unit 57, thereby moving the cutter 56 and changing the length L of the tape T to be cut by the cutter 56. Various operations of the cutting length changing unit 57 in the following description are performed by the control unit 26 controlling the cutting length changing unit 57.

In the embodiment described herein, the cutting length changing unit 57 changes the length L of the tape T to be cut by the cutter 56, based on information relating to the sheet bundle 5 which is acquired by the interface 21. For example, the cutting length changing unit 57 changes the length L of the tape T to be cut by the cutter 56, based on information relating to the number of sheets S forming the sheet bundle 5, which is acquired by the interface 21. For example, the cutting length changing unit 57 changes a cutting position of the tape T so as to lengthen the length L of the tape T when the number of sheets S forming the sheet bundle 5 is greater than a preset reference value. In the embodiment described herein, the cutting length changing unit 57 changes the cutting position of the tape T so as to gradually lengthen the length L of the tape T as the number of sheets S forming the sheet bundle 5 increases. The cutting length changing unit 57 changes the cutting position of the tape T so as to shorten the length L of the tape T when the number of sheets S forming the sheet bundle 5 is smaller than the reference value or another preset reference value. In the embodiment described herein, the cutting length changing unit 57 changes the cutting position of the tape T so as to gradually shorten the length L of the tape T as the number of sheets S forming the sheet bundle 5 decreases.

From another viewpoint, for example, when the sheet bundle 5 is thicker than a preset reference thickness since the number of sheets S increases, the cutting length changing unit 57 changes the cutting position of the tape T so as to lengthen the length L of the tape T approximately as much as the thickened amount of the sheet bundle 5 compared to the reference thickness. When the sheet bundle 5 is thinner than the preset reference thickness or another preset reference thickness since the number of sheets S decreases, the cutting length changing unit 57 changes the cutting position of the tape T so as to shorten the length L of the tape T approximately as much as the thinned amount of the sheet bundle 5 compared to the reference thickness or another preset reference thickness.

Next, the tape holding unit 58 will be described.

In a state where the tape holding unit 58 holds a posture of the tape T so as to be substantially flat, the tape holding unit 58 holds the tape T. The tape holding unit 58 is movable along the longitudinal direction of the tape T by a movement mechanism (not illustrated). The tape holding unit 58 is movable in the direction approaching the tape T and in the direction away from the tape T by a movement mechanism (not illustrated).

In the embodiment described herein, the tape holding unit 58 includes a first holding member 81, a second holding member 82, and a distance changing unit 83. The first holding member 81 comes into contact with a first end portion 65*a* of the tape T to be cut by the cutter 56, thereby holding the first end portion 65*a* (refer to FIG. 14). The second holding member 82 comes into contact with a second end portion 65*b* of the tape T to be cut by the cutter 56, thereby holding the second end portion 65*b* (refer to FIG. 14). The second end portion 65*b* of the tape T is an end portion on a side opposite to the first end portion 65*a*. For example, the second holding member 82 is movable to and from the first holding member 81 in the sheet bundle thickness direction Z. The first holding member 81 may be fixed at the stationary position, or may be movable to and from the second holding member 82.

As illustrated in FIG. 3, when the length L of the tape T to be cut by the cutter 56 is changed, the distance changing unit 83 changes a distance M between the first holding member 81 and the second holding member 82 in the sheet bundle thickness direction Z. For example, the distance changing unit 83 relatively moves the second holding member 82 with respect to the first holding member 81 in the sheet bundle thickness direction Z, thereby changing the distance M between the first holding member 81 and the second holding member 82. For example, the distance changing unit 83 includes a support member 85 connected to the second holding member 82, and a drive source 86 which moves the second holding member 82 via the support member 85. For example, the support member 85 is a ball spring connected to the second holding member 82. The drive source 86 is a motor which moves the second holding member 82 by driving the ball spring. A configuration of the support member 85 and the drive source 86 is not limited to the above-described example. For example, the support member 85 may be a cam which is in contact with the second holding member 82. The drive source 86 may be a solenoid which moves the second holding member 82 via the support member 85. In this case, the support member 85 is a connection member which connects the second holding member 82 and the solenoid.

In the embodiment described herein, the distance changing unit 83 is controlled by the control unit 26 (to be described later). For example, the control unit 26 controls the drive source 86 of the distance changing unit 83, thereby moving the second holding member 82 and changing the distance M between the first holding member 81 and the second holding member 82. Various operations of the distance changing unit 83 in the following description are performed by the control unit 26 controlling the distance changing unit 83.

In the embodiment described herein, the distance changing unit 83 changes the distance M between the first holding member 81 and the second holding member 82, based on the information relating to the sheet bundle 5 which is acquired by the interface 21. For example, the distance changing unit 83 changes the distance M between the first holding member 81 and the second holding member 82, based on the information relating to the number of sheets S forming the sheet bundle 5, which is acquired by the interface 21. For example, the distance changing unit 83 lengthens the distance M between the first holding member 81 and the second holding member 82, when the number of sheets S forming the sheet bundle 5 is greater than the preset reference value. In the embodiment described herein, the distance changing unit 83 gradually lengthens the distance M between the first holding member 81 and the second holding member 82, as the number of sheets S forming the sheet bundle 5 increases. The distance changing unit 83 shortens the distance M between the first holding member 81 and the second holding member 82, when the number of sheets S forming the sheet bundle 5 is smaller than the reference value or another preset reference value. In the embodiment described herein, the distance changing unit 83 gradually shortens the distance M between the first holding member 81 and the second holding member 82, as the number of sheets S forming the sheet bundle 5 decreases.

From another viewpoint, when the length L of the tape T to be cut by the cutter 56 is longer than the preset reference length, the distance changing unit 83 lengthens the distance M between the first holding member 81 and the second holding member 82 approximately as much as the lengthened amount of the length L of the tape T compared to the reference length. When the length L of the tape T to be cut by the cutter 56 is shorter than the reference length or another preset reference length, the distance changing unit 83 shortens the distance M between the first holding member 81 and the second holding member 82 approximately as much as the shortened amount of the length L of the tape T compared to the reference length or another preset reference length. The above-described changing amount of the distance M between the first holding member 81 and the second holding member 82 may be substantially the same as or may be different from the changing amount of the length L of the tape T to be cut by the cutter 56.

The tape attachment unit (tape wrapping unit) 59 includes a first roller 91, a second roller 92, a first spring 93, and a second spring 94. The first spring 93 biases the first roller 91 toward the second roller 92. The second spring 94 biases the second roller 92 toward the first roller 91. The first roller 91 and the first spring 93 cooperate with each other, thereby forming an example of a "first biasing unit". The second roller 92 and the second spring 94 cooperate with each other, thereby forming an example of a "second biasing unit". The edge portion 5*a* of the sheet bundle 5 together with the tape T is inserted into a portion between the first roller 91 and the second roller 92, when the tape T is attached thereto. In this manner, the tape T is bent so that the edge portion 5*a* of the sheet bundle 5 is wrapped by the tape attachment unit 59, and the tape T is attached to the edge portion 5*a* of the sheet bundle 5.

Next, the memory unit 25 and the control unit 26 (refer to FIG. 2) will be described.

The memory unit 25 is formed using a storage device arranged in the sheet binding device 1. Various programs are stored in the memory unit 25. In the memory unit 25, various patterns relating to the number of sheets S forming the sheet bundle 5 and information relating to the length L of the tape T to be cut by the cutter 56 which corresponds to the respective patterns are correlated with each other so as to be managed therein. In the memory unit 25, various patterns relating to the number of sheets S forming the sheet bundle 5 and information relating to the distance M between the first holding member 81 and the second holding member 82 which corresponds to the respective patterns are correlated with each other so as to be managed therein.

The control unit 26 includes a control circuit including CPU, ROM, and RAM which are arranged in the sheet binding device 1. For example, in the control unit 26, a processor such as CPU to execute a program controls an operation of the sheet binding device 1. For example, the control unit 26 controls various operations of the bundle preparation unit 22, the sheet shifting unit 23, and the tape processing unit 24. For example, the control unit 26 controls the cutting length changing unit 57 and the distance changing unit 83, based on information relating to the sheet bundle 5 which is acquired through the interface 21 and information obtained by referring to the memory unit 25.

Next, an operation example of the sheet binding device 1 will be described. FIGS. 5 to 17 are front views illustrating the operation example of the sheet binding device 1.

First, as illustrated in FIG. 3, the sheet binding device 1 moves the stopper 33 to the regulating position, thereby blocking the sheet S conveyed to the main guide 31. In this manner, the multiple sheets S are sequentially stacked one on another, thereby forming the sheet bundle 5. Subsequently, the sheet binding device 1 moves the stopper 33 to the releasing position. The sheet binding device 1 switches the switching member 34 in the second conveying direction.

Subsequently, as illustrated in FIG. 5, the sheet binding device 1 moves the second roller 42 toward the first roller 41. In this manner, the sheet bundle 5 and the outer peripheral surface 42*s* of the second roller 42 are deformed in an arc shape along the outer peripheral surface 41*s* of the first roller 41.

Figure 6:
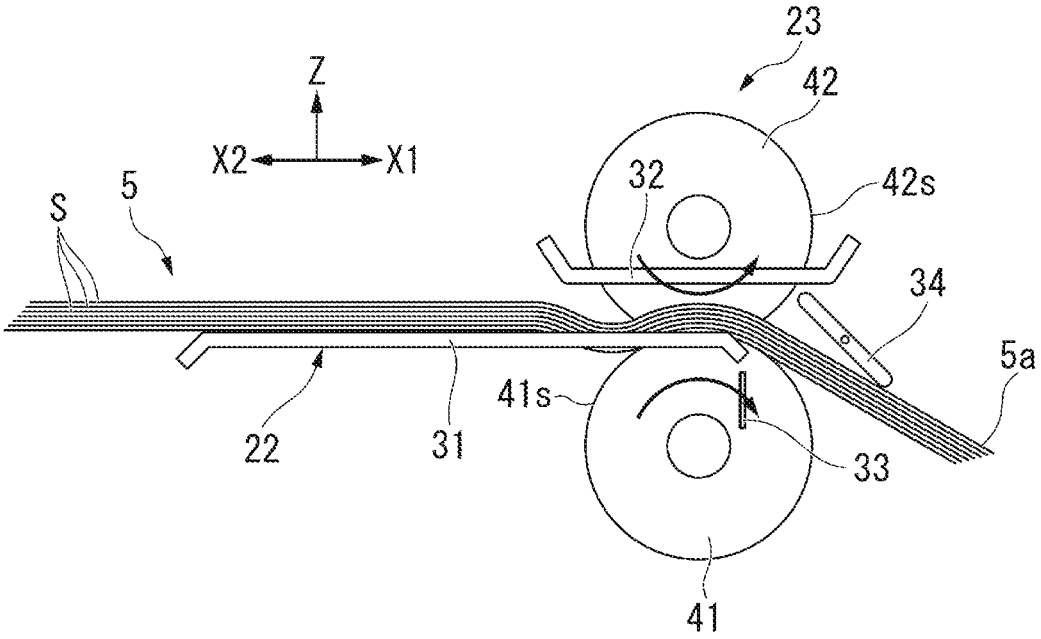

Then, as illustrated in FIG. 6, in a state where the sheet bundle 5 is interposed between the first roller 41 and the second roller 42, the sheet binding device 1 rotates the first roller 41 forward. In this manner, the second roller 42 maintains a state of being recessed along the outer peripheral surface 41*s* of the first roller 41, and is rotated in accordance with the rotation of the first roller 41. As a result, this forms a state where the multiple sheets S are shifted in the edge portion 5*a* of the sheet bundle 5 in the sheet conveying direction X1 in a stepwise manner. The "edge portion 5*a* of the sheet bundle 5" in the following description means the edge portion 5*a* of the sheet bundle 5 in which the multiple sheets S are shifted in the stepwise manner.

Here, a principle in which the multiple sheets S are shifted in the stepwise manner will be described.

Figure 7:
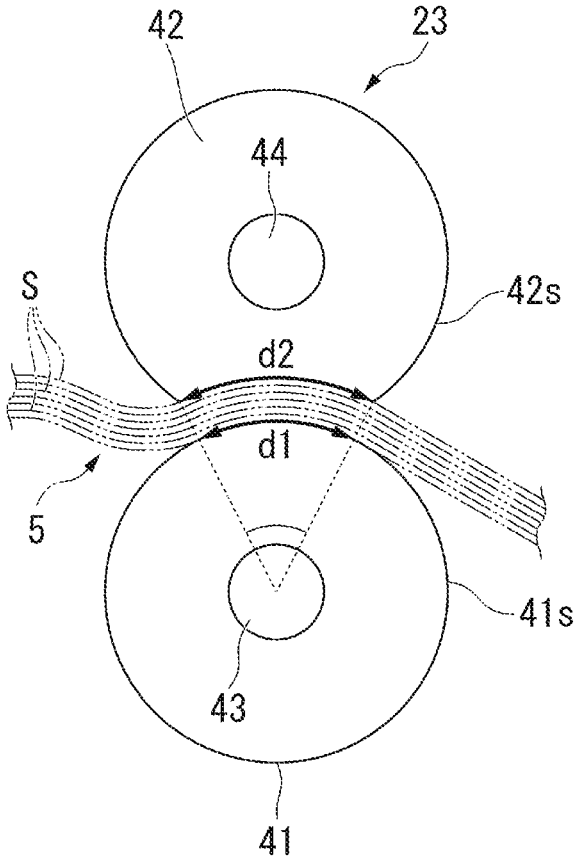
FIG. 7 illustrate a principle of shifted sheets.

FIG. 7 is a front view illustrating the principle in which the multiple sheets S are shifted in the stepwise manner.

As illustrated in FIG. 7, if the second roller 42 comes into pressing contact with the first roller 41 via the sheet bundle 5, the outer peripheral surface 42*s* of the second roller 42 is deformed in an arc shape along the outer peripheral surface 41*s* of the first roller 41. Here, a length (arc length) d1 in a circumferential direction of a portion in contact with the sheet bundle 5 on the outer peripheral surface 41*s* of the first roller 41 is referred to as a "first length d1". A length d2 in a direction along the circumferential direction of the first roller 41 of a portion (recessed portion) in contact with the sheet bundle 5 on the outer peripheral surface 42*s* of the second roller 42 is referred to as a "second length d2". The second length d2 is longer than the first length d1. In this state, the sheet binding device 1 rotates the first roller 41 and the second roller 42, thereby feeding the sheet bundle 5 in the sheet conveying direction X1. At this time, a movement distance of the outer peripheral surface 42*s* of the second roller 42 is longer than a movement distance of the outer peripheral surface 41*s* of the first roller 41. That is, a feeding amount of the sheet bundle 5 in the sheet conveying direction X1 increases as the sheet bundle 5 is closer to the second roller 42. This forms a state where the multiple sheets S are shifted in the edge portion 5*a* of the sheet bundle 5 in a stepwise manner.

Figure 8:
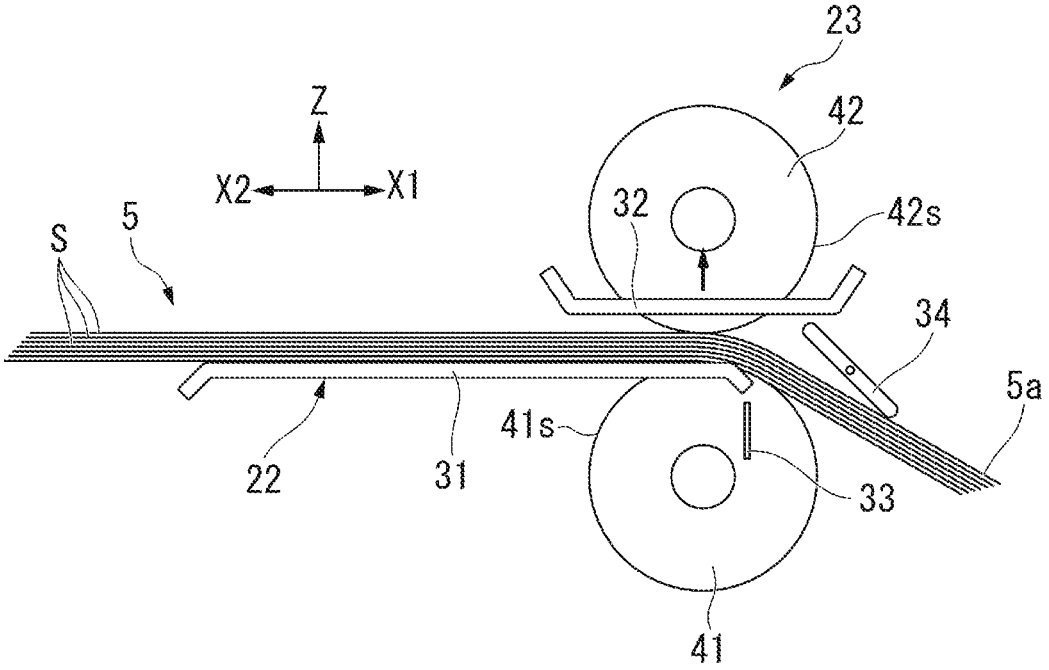
FIGS. 8-10 further illustrate an operation of the sheet shifting unit of the sheet binding device.

Subsequently, as illustrated in FIG. 8, the sheet binding device 1 moves the second roller 42 in a direction away from the first roller 41. This eliminates the recess of the outer peripheral surface 42*s* of the second roller 42.

Figure 9:
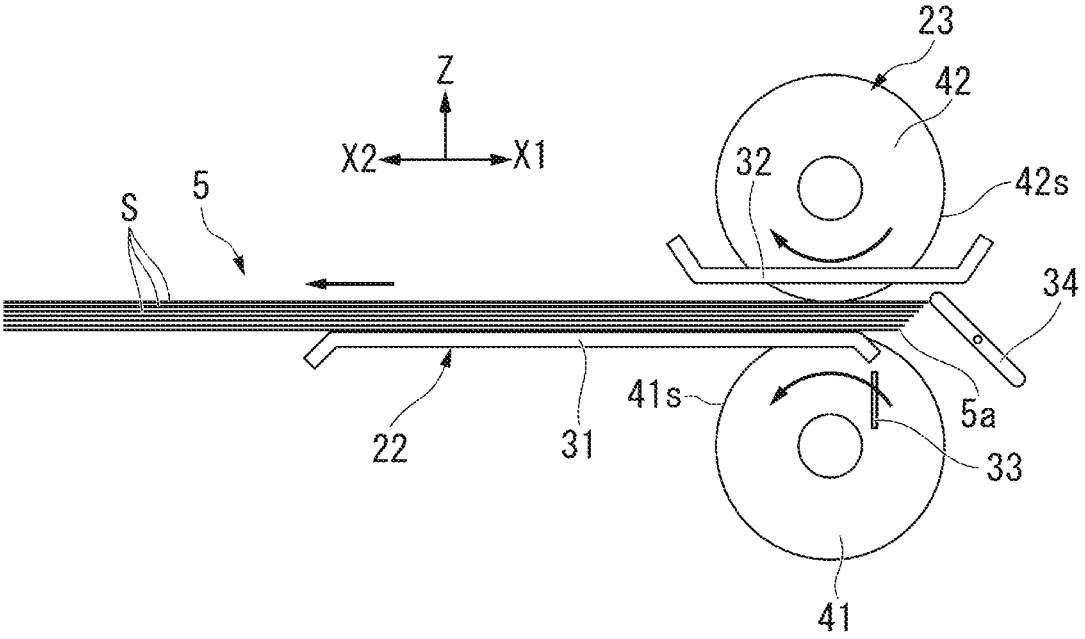

Subsequently, as illustrated in FIG. 9, the sheet binding device 1 rotates the first roller 41 and the second roller 42 rearward, thereby moving the sheet bundle 5 in a direction X2 opposite to the sheet conveying direction X1.

Figure 10:
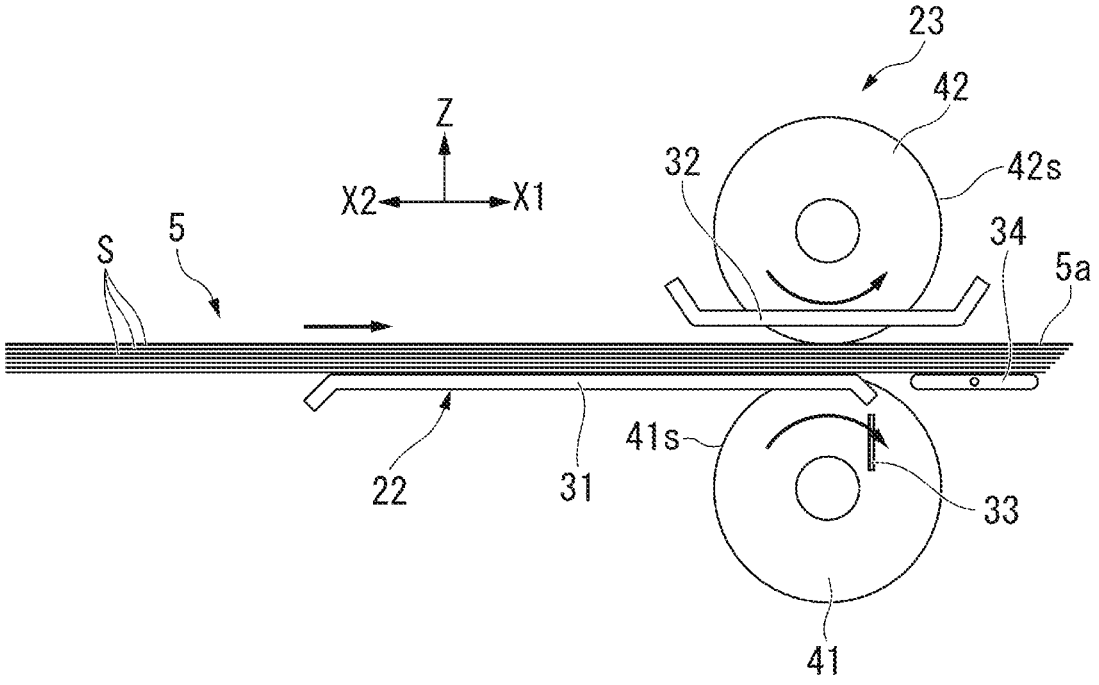

Subsequently, as illustrated in FIG. 10, the sheet binding device 1 switches the switching member 34, thereby switching the conveying path from the second conveying direction to the first conveying direction. Then, the sheet binding device 1 rotates the first roller 41 and the second roller 42 forward, thereby moving the sheet bundle 5 toward the tape attachment unit 59.

Figure 11:
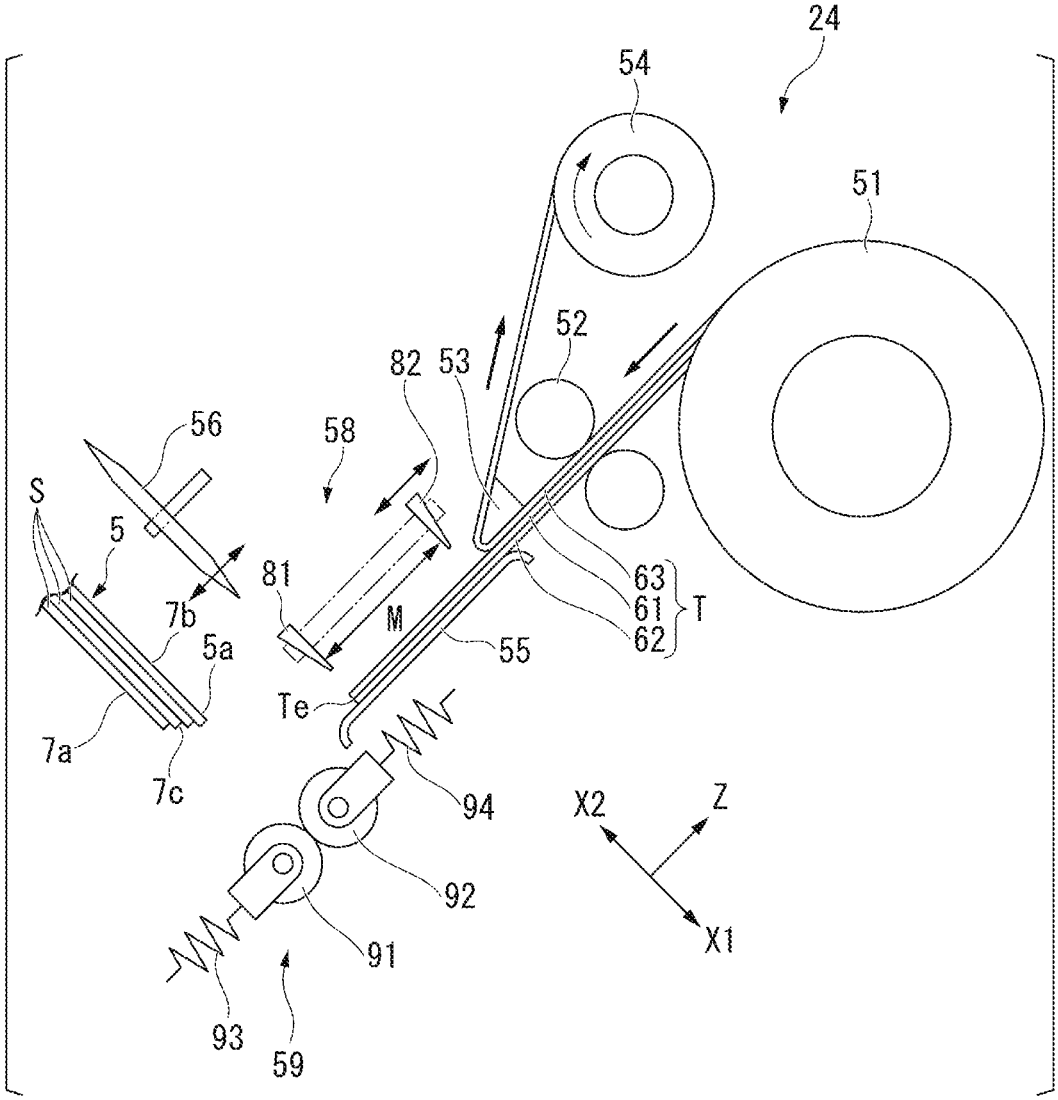
FIGS. 11-17 illustrate an operation of a tape processing unit of the sheet binding device.

Subsequently, as illustrated in FIG. 11, the sheet binding device 1 changes the length L of the tape T to be cut by the cutter 56, based on the information relating to the sheet bundle 5 which is acquired through the interface 21 (for example, the information relating to the number of sheets S forming the sheet bundle 5). For example, in the embodiment described herein, the control unit 26 controls the drive source 73 of the cutting length changing unit 57, thereby changing a position of the cutter 56. The sheet binding device 1 changes the distance M between the first holding member 81 and the second holding member 82, based on the information relating to the sheet bundle 5 which is acquired through the interface 21 (for example, the information relating to the number of sheets S forming the sheet bundle 5). For example, in the embodiment described herein, the control unit 26 controls the drive source 86 of the tape holding unit 58, thereby changing the distance M between the first holding member 81 and the second holding member 82. In this state, the tape holding unit 58 is located at a position away from the tape T.

Figure 12:
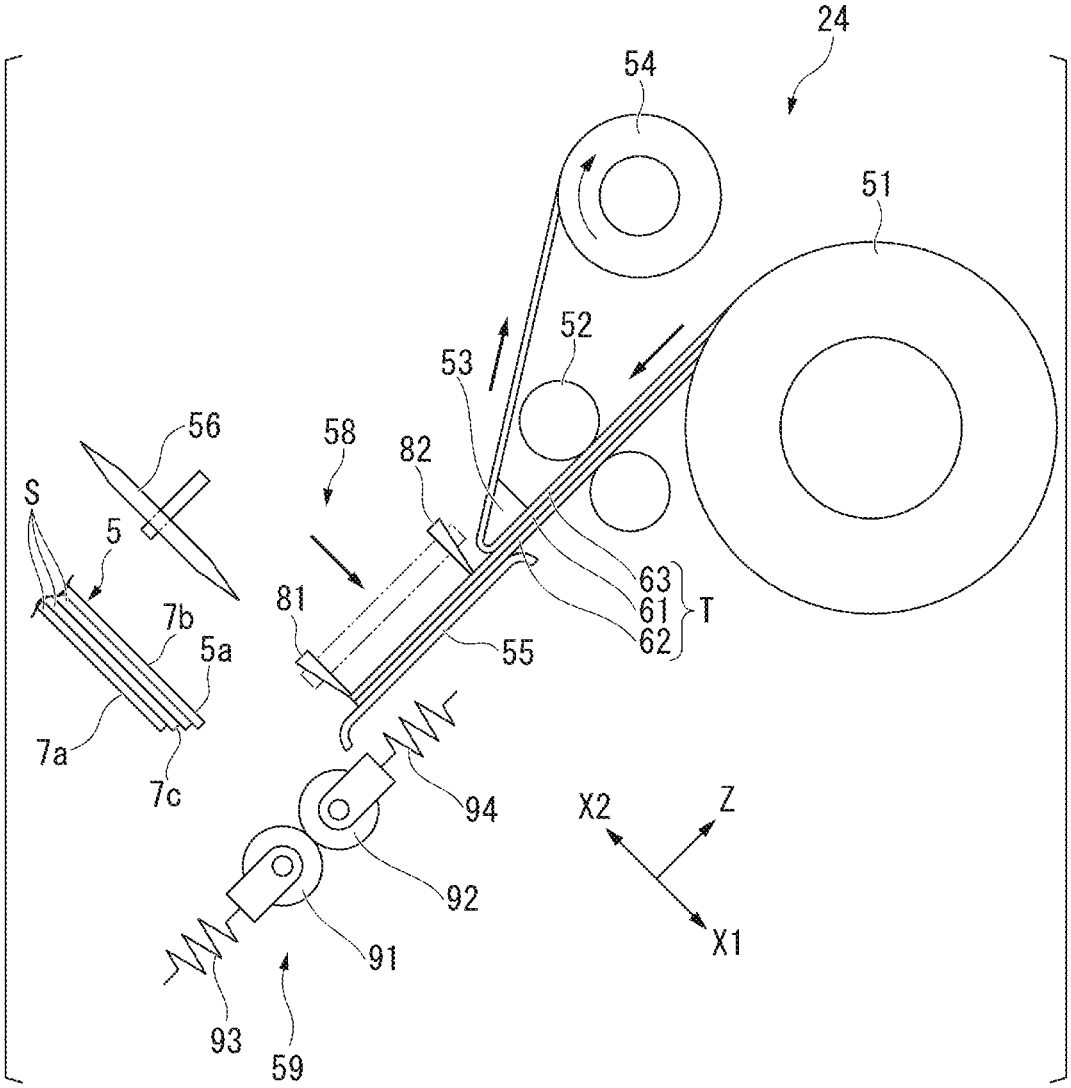

Subsequently, as illustrated in FIG. 12, the sheet binding device 1 brings the tape holding unit 58 into contact with the tape T, thereby supporting the tape T in a state where a posture of the tape T is held.

Figure 13:
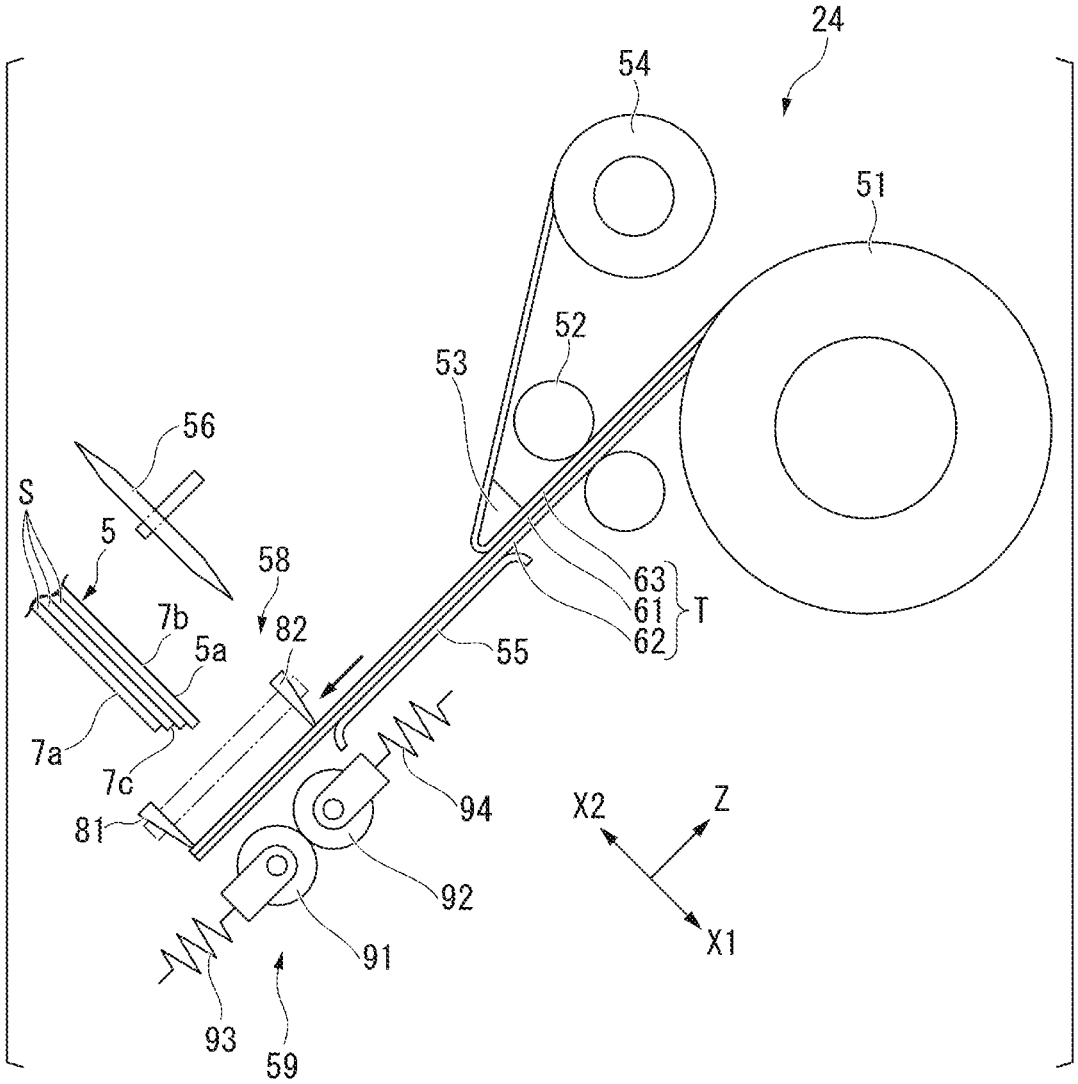

Subsequently, as illustrated in FIG. 13, the sheet binding device 1 moves the tape holding unit 58 between the sheet bundle 5 and the tape attachment unit 59. For example, the tape holding unit 58 arranges the tape T across the first roller 91 and the second roller 92.

Figure 14:
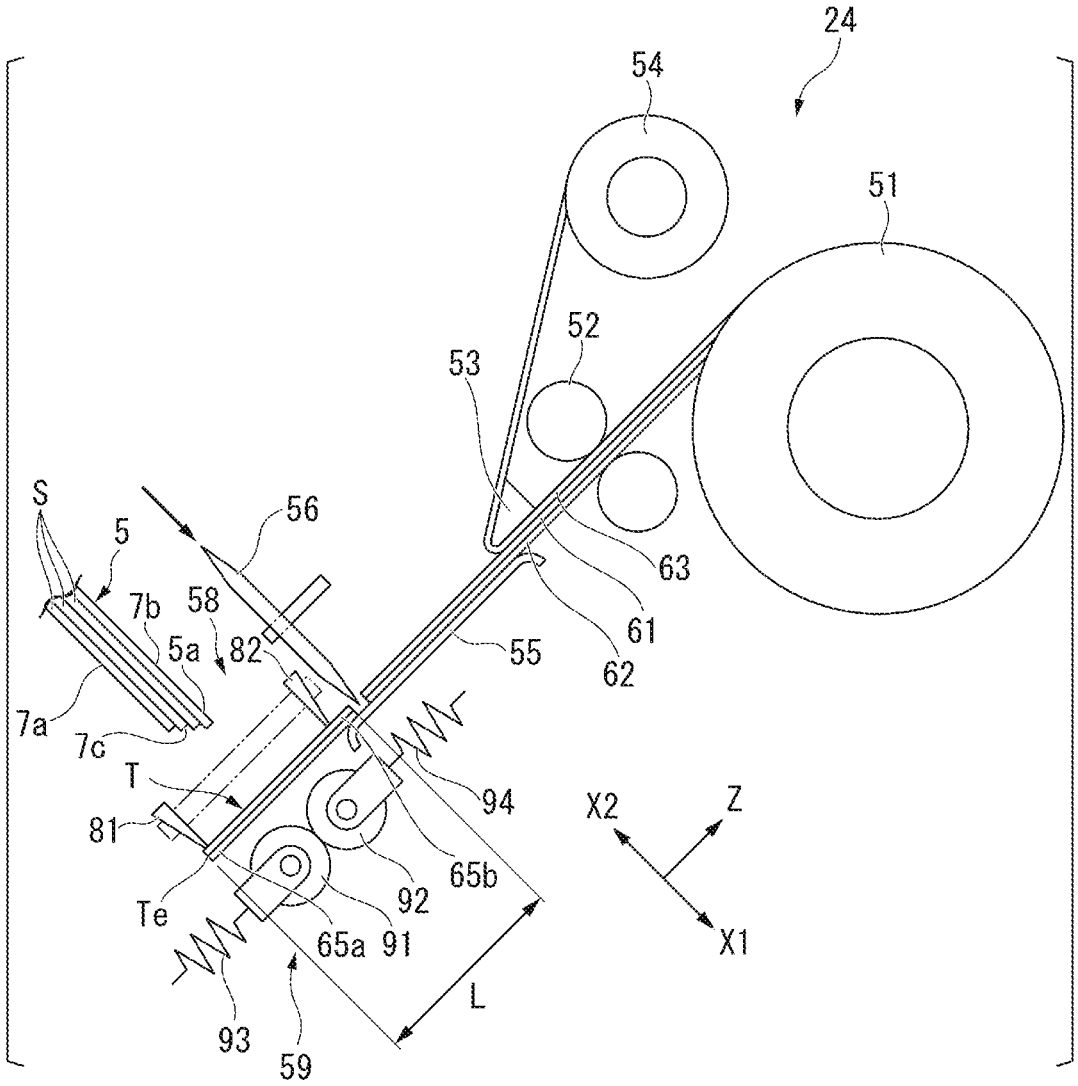

Subsequently, as illustrated in FIG. 14, in the sheet binding device 1, the cutter 56 cuts the strip-like tape T, and forms the tape T having a sheet shape. In this manner, the tape T is cut so as to have a required length.

Figure 15:
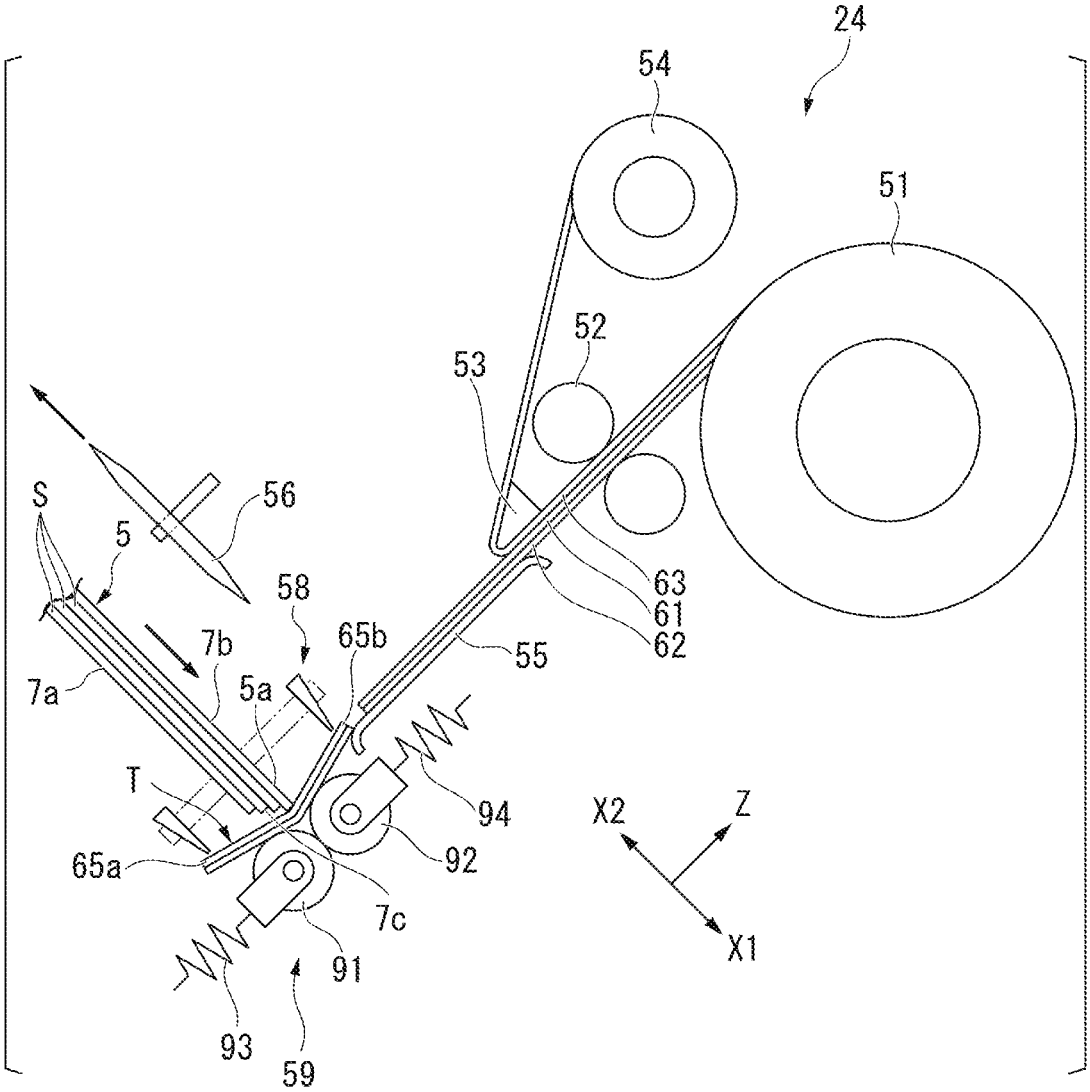

Subsequently, as illustrated in FIG. 15, for example, the sheet binding device 1 rotates the first roller 41 and the second roller 42 forward, thereby moving the sheet bundle 5 toward the tape attachment unit 59. Then, the sheet binding device 1 brings the tip end of the edge portion 5*a* of the sheet bundle 5 into contact with the tape T. In this manner, the sheet binding device 1 inserts the edge portion 5*a* of the sheet bundle 5 together with the tape T into a portion between the first roller 91 and the second roller 92.

Figure 16:
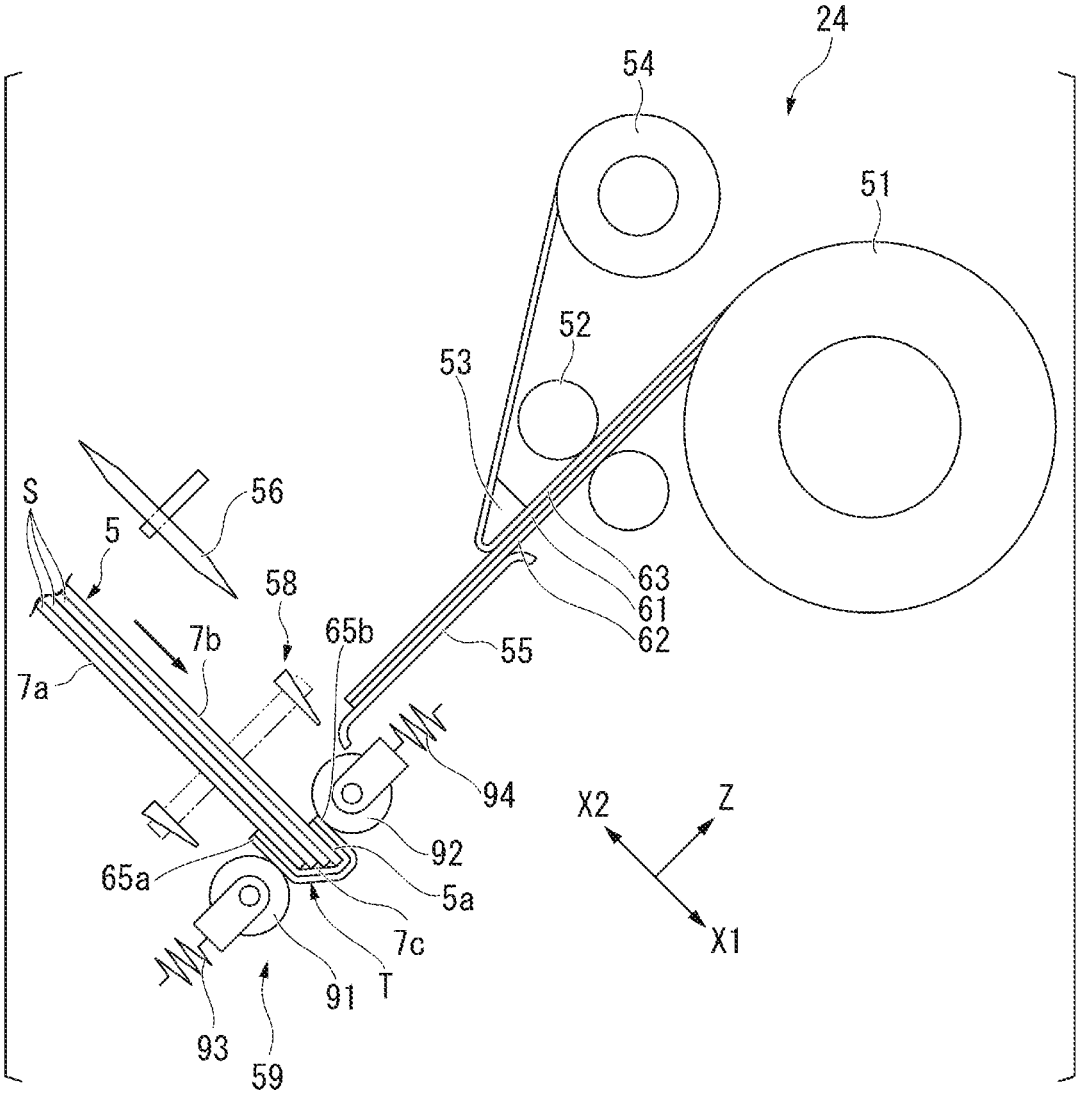

Subsequently, as illustrated in FIG. 16, if the edge portion 5*a* of the sheet bundle 5 together with the tape T is inserted into the portion between the first roller 91 and the second roller 92, the first roller 91 and the second roller 92 are moved along an outer shape of the edge portion 5*a* of the sheet bundle 5. In this manner, the first roller 91 and the second roller 92 press the tape T against the edge portion 5*a* of the sheet bundle 5. As a result, the tape T subsequently adheres to a stepwise portion of the sheet bundle 5. Here, the edge portion 5*a* of the sheet bundle 5 has a first surface 7*a*, a second surface 7*b*, and an end surface 7*c*. The first surface 7*a* and the second surface 7*b* are formed along the sheet conveying direction X1. The second surface 7*b* is located on a side opposite to the first surface 7*a*. The end surface 7*c* is located between the first surface 7*a* and the second surface 7*b*, thereby shifting the multiple sheets S in the stepwise manner. The sheet S is attached over the first surface 7*a*, the end surface 7*c*, and the second surface 7*b* in the edge portion 5*a* of the sheet bundle 5. In this manner, all of the sheets S including middle pages of the sheet bundle 5 are integrated by the tape T. In this manner, processing for attaching the tape T to the edge portion 5*a* of the sheet bundle 5 is completed.

Figure 17:
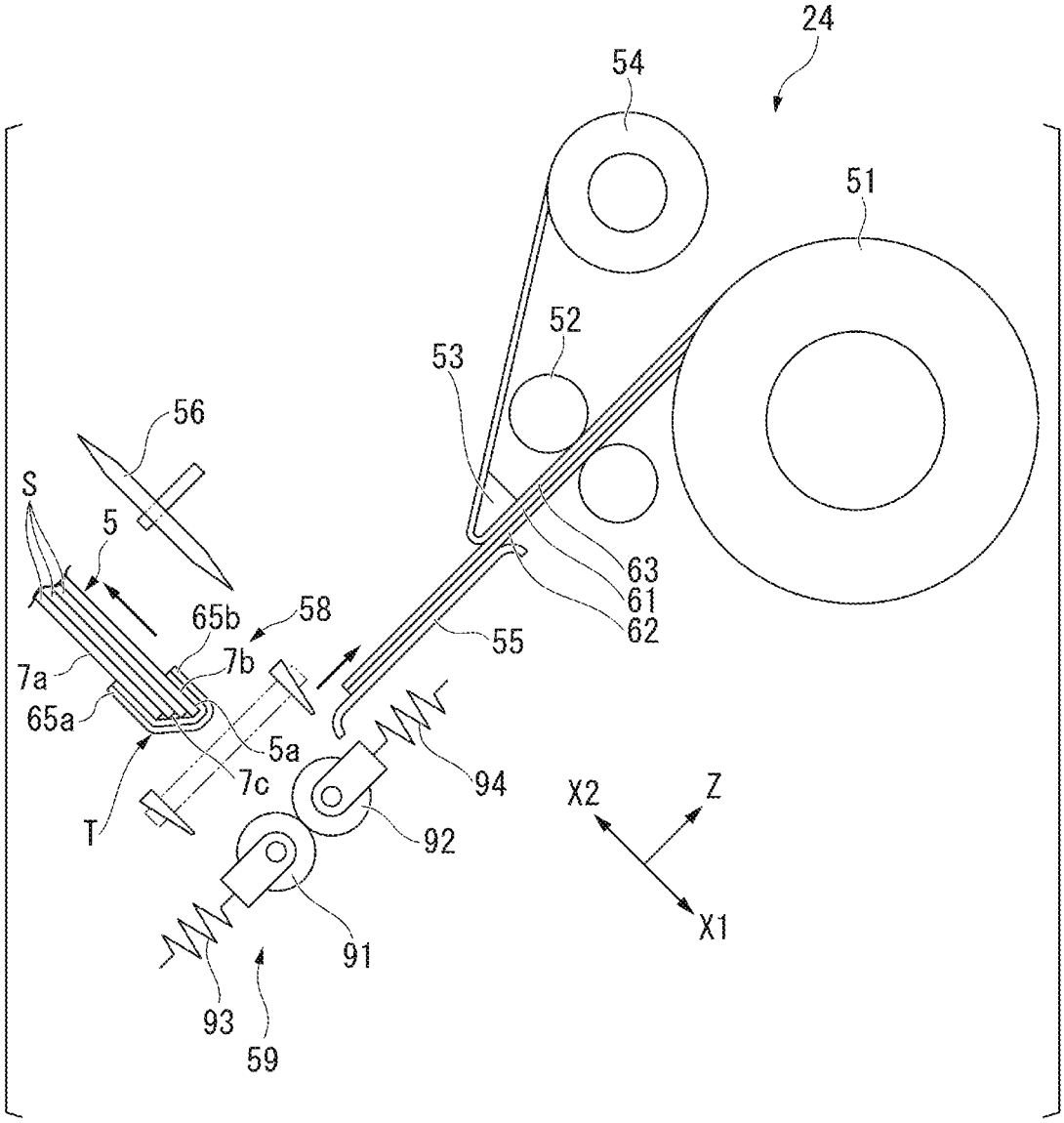

Subsequently, as illustrated in FIG. 17, the sheet binding device 1 rotates the first roller 41 and the second roller 42 rearward, thereby drawing the sheet bundle 5 from a portion between the first roller 91 and the second roller 92. Then, the sheet binding device 1 further rotates the first roller 41 and the second roller 42 rearward, thereby discharging the sheet bundle 5 to a discharge unit of the sheet binding device 1.

According to the above-described configuration, the sheet binding device 1 completes a series of operations.

According to this configuration, it is possible to reduce the number of replenished consumables or the cost required for the replenishment in the sheet binding device 1. That is, in the embodiment described herein, the sheet binding device 1 includes the cutting length changing unit 57 which changes the length L of the tape T to be cut by the cutter 56, based on the information relating to the sheet bundle 5. According to this configuration, depending on a state of each sheet bundle 5, it is possible to prevent the sheet bundle 5 from being bound by the tape T which is unnecessarily long. In this manner, it is possible to reduce the number of replenished tapes T or the cost required for the replenishment of the tapes T.

In the embodiment described herein, the tape holding unit 58 changes the distance M between the first holding member 81 and the second holding member 82, based on the information relating to the sheet bundle 5. According to this configuration, even if the length L of the tape T is changed, the tape T can be more suitably held by the tape holding unit 58.

In the embodiment described herein, the sheet binding device 1 includes the sheet shifting unit 23 which shifts the multiple sheets S forming the sheet bundle 5 at the edge portion 5*a* of the sheet bundle 5. For example, the sheet shifting unit 23 changes a pressing contact amount of the second roller 42 with respect to the first roller 41. In this manner, it is possible to change a sheet shifted amount of the multiple sheets S in the edge portion 5*a* of the sheet bundle 5. Here, according to the configuration of the embodiment described herein, for example, when the sheet shifted amount of the multiple sheets S is changed in the edge portion 5*a* of the sheet bundle 5, it is possible to change the length L of the tape T to be cut by the cutter 56 in accordance with a size of the sheet shifted amount of the multiple sheets S. That is, for example, when the sheet shifted amount of the multiple sheets S is greater than the preset reference value, it is possible to lengthen the length L of the tape T to be cut by the cutter 56.

First Modification Example

Next, a first modification example of the first embodiment will be described. The sheet binding device 1 according to the above-described first embodiment, through the interface 21, acquires the information relating to the sheet bundle 5. The sheet binding device 1 according to the modification example described herein, by a detection unit D arranged in the sheet binding device 1, acquires the information relating to the sheet bundle 5. The configurations other than the following are the same as the configurations according to the above-described first embodiment.

The sheet binding device 1 according to the modification example described herein the detection unit D arranged in the conveying path of the sheet binding device 1 (refer to FIGS. 1 and 2). For example, the detection unit D includes a sensor which detects a sheet passing through the conveying path. The control unit counts the number of sheets S passing through the conveying path detected by the sensor, and acquires the information relating to the number of sheets S forming the sheet bundle 5. The cutting length changing unit 57 changes the length L of the tape T to be cut by the cutter 56, based on the information relating to the sheet bundle 5 which is acquired by the detection unit D (for example, the information relating to the number of sheets S forming the sheet bundle 5). The tape holding unit 58 changes the distance M between the first holding member 81 and the second holding member 82, based on the information relating to the sheet bundle 5 which is acquired by the detection unit D (for example, the information relating to the number of sheets S forming the sheet bundle 5).

Second Modification Example

Next, a second modification example according to the first embodiment will be described. The sheet binding device 1 according to the first embodiment changes the length L of the tape T to be cut by the cutter 56, based on the information relating to the number of sheets S forming the sheet bundle 5, as the information relating to the sheet bundle 5. In contrast, the sheet binding device 1 according to the modification example described herein changes the length L of the tape T to be cut by the cutter 56, based on information relating to a thickness of the sheet bundle 5, as the information relating to the sheet bundle 5. The configurations other than the following are the same as the configurations according to the above-described first embodiment.

The sheet binding device 1 according to the modification example described herein includes the detection unit D arranged in the sheet binding device 1 (refer to FIG. 3). The detection unit D includes a sensor 102 which detects the thickness of the sheet bundle 5, and acquires the information relating to the thickness of the sheet bundle 5. In the embodiment described herein, the detection unit D includes a moving body 101 whose position is changed in accordance with the thickness of the sheet bundle 5 by coming into contact with the sheet bundle 5 in the sheet bundle thickness direction Z, and the sensor 102 which detects a movement amount of the moving body 101. The detection unit D detects the thickness of the sheet bundle 5, based on the movement amount of the moving body 101.

According to the modification example described herein, the cutting length changing unit 57 changes the length L of the tape T to be cut by the cutter 56, based on the information relating to the thickness of the sheet bundle 5 which is acquired by the detection unit D. The tape holding unit 58 changes the distance M between the first holding member 81 and the second holding member 82, based on the information relating to the thickness of the sheet bundle 5 which is acquired by the detection unit D. A specific process of the cutting length changing unit 57 and the tape holding unit 58 is substantially the same as a specific process of the cutting length changing unit 57 and the tape holding unit 58 according to the first embodiment. That is, the specific process of the cutting length changing unit 57 and the tape holding unit 58 may be alternatively rad as follows in the description relating to the cutting length changing unit 57 and the tape holding unit 58 according to the first embodiment. For example, the description of "the number of sheets S forming the sheet bundle 5" is replaced with "the thickness of the sheet bundle 5". The description of "smaller than the reference value" is replaced with "thinner than the reference value". The description of "as the number of sheets S increases" is replaced with "as the thickness of the sheet bundle 5 is thickened". The description of "as the number of sheets S decreases" is replaced with "as the thickness of the sheet bundle 5 is thinned". The description of "approximately as much as the thickened amount of the sheet bundle 5 compared to the reference thickness" is replaced with "as approximately the same amount as the thickened amount of the sheet bundle 5 compared to the reference thickness". The description of "approximately as much as the thinned amount of the sheet bundle 5 compared to the reference thickness or another preset reference thickness" is replaced with "as approximately the same amount as the thinned amount of the sheet bundle 5 compared to the reference thickness or another preset reference thickness".

According to this configuration, similarly to the first embodiment, it is possible to reduce the number of replenished tapes T or the cost required for the replenishment of the tapes T.

A configuration of the detection unit D is not limited to the above-described example. For example, the detection unit D may be a pressure sensor arranged in the second roller 42 of the sheet shifting unit 23. The detection unit D arranged in this way may acquire the information relating to the thickness of the sheet bundle 5 by detecting internal pressure of the second roller 42 when the second roller 42 comes into pressing contact with the first roller 41. Instead of the detection unit D acquiring the information relating to the thickness of the sheet bundle 5, in the sheet binding device 1, the interface 21 may acquire the information relating the thickness of the sheet bundle 5 from an external apparatus (for example, the image forming apparatus 2).

Second Embodiment

Next, a second embodiment will be described. The embodiment described herein is different from the first embodiment in that the cutting length changing unit 57 does not include the drive source 73 and is operated by being mechanically interlocked with the moving body 101 of the detection unit D. The configurations other than the following are the same as those according to the first embodiment.

Figure 18:
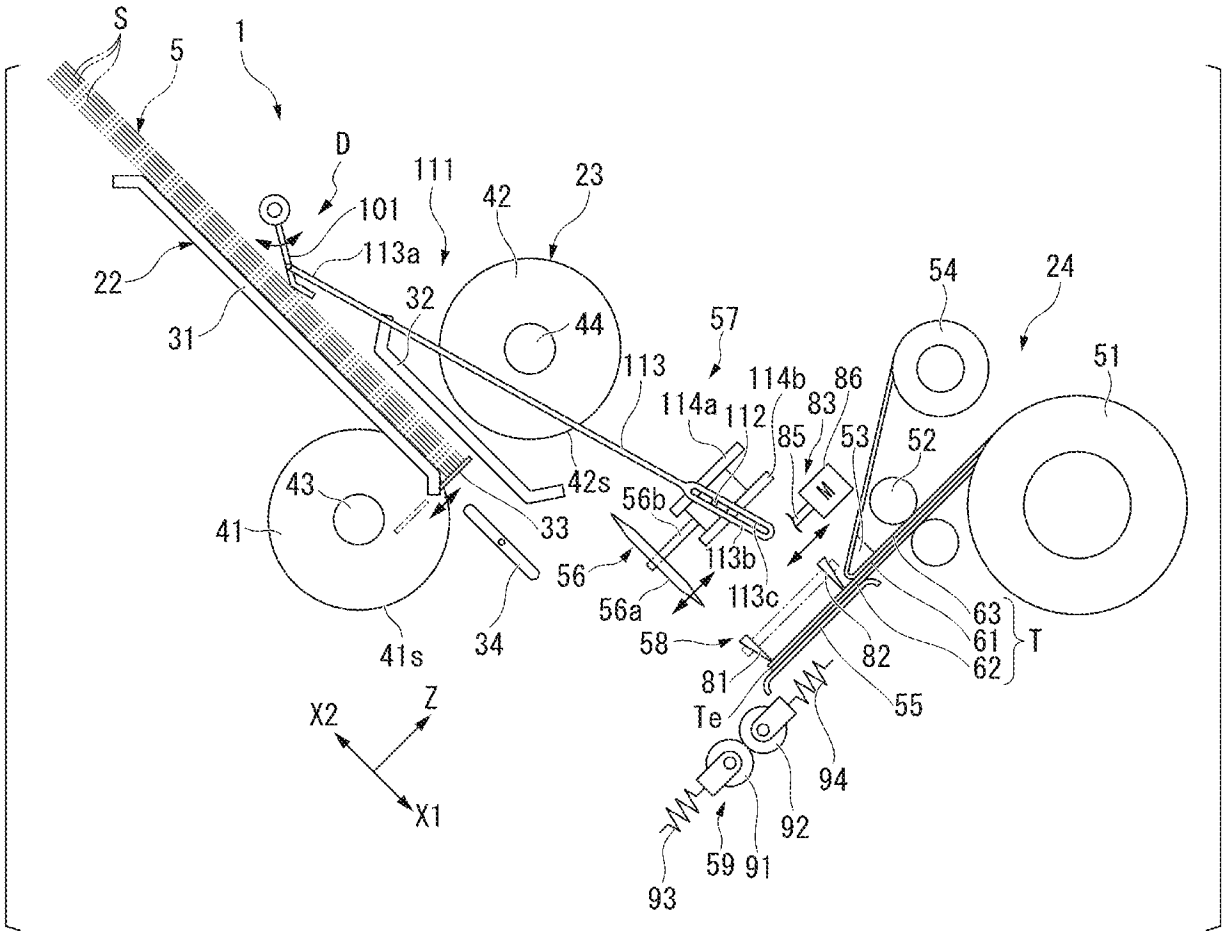
FIG. 18 is a front view illustrating an internal configuration of a sheet binding device according to a second embodiment.

FIG. 18 is a front view illustrating an internal configuration of the sheet binding device 1 according to the embodiment described herein. As illustrated in FIG. 18, the sheet binding device 1 according to the embodiment described herein includes the detection unit D arranged in the sheet binding device 1. The detection unit D according to the embodiment described herein includes the moving body 101 whose position is changed in accordance with the thickness of the sheet bundle 5 by coming into contact with the sheet bundle 5 in the sheet bundle thickness direction Z. Information relating to the sheet S may be numerical information (digital data or analog data) acquired through a sensor, or a change in a certain physical amount (for example, a position change of the moving body 101). That is, without being limited to the digital data or the analog data, the "information" described in this application may be regarded as the change in the certain physical amount of configuration elements of the sheet binding device 1. For example, in the embodiment described herein, if the sheet bundle 5 is thick, the moving body 101 is pressed up by the sheet bundle 5 and is moved in the direction away from the main guide 31. If the sheet bundle 5 is thin, the moving body 101 is moved in the direction approaching the main guide 31 due to its own weight or by a biasing member (not illustrated).

The cutting length changing unit 57 according to the embodiment described herein has an interlocking mechanism 111 which mechanically interlocks a position of the moving body 101 with a relative position of the cutter 56 with respect to the tip end Te of the tape T. For example, the interlocking mechanism 111 interlocks a movement (movement amount) of the moving body 101 in the sheet bundle thickness direction Z with a movement (movement amount) of the cutter 56 in the sheet bundle thickness direction Z. In the embodiment described herein, the interlocking mechanism 111 includes a connection member 112, a link member 113, and a pair of guide members 114*a* and 114*b*. For example, the connection member 112 is a pin arranged in the cutter 56. A first end portion 113*a* of the link member 113 is connected to the moving body 101 so as to be pivotable. A second end portion 113*b* of the link member 113 is provided with a long hole 113*c* through which the connection member 112 passes. The second end portion 113*b* of the link member 113 supports the connection member 112 passing through the long hole 113*c* so as to be pivotable. The guide members 114*a* and 114*b* are located separately on both sides of the cutter 56, thereby regulating free inclination of the cutter 56. The guide members 114*a* and 114*b* guide the cutter 56 along the sheet bundle thickness direction Z.

For example, according to the above-described configuration, when the thickness of the sheet bundle 5 is greater than the reference value, the interlocking mechanism 111 moves the cutter 56 upward from the reference position in the sheet bundle thickness direction Z. In this manner, when the thickness of the sheet bundle 5 is greater than the reference value, the interlocking mechanism 111 changes the cutting position of the tape T so as to lengthen the length L of the tape T to be cut by the cutter 56. For example, as the thickness of the sheet bundle 5 becomes thicker, the interlocking mechanism 111 changes the cutting position of the tape T so as to gradually lengthen the length L of the tape T. When the thickness of the sheet bundle 5 is smaller than the reference value, the interlocking mechanism 111 moves the cutter 56 downward from the reference position in the sheet bundle thickness direction Z. In this manner, when the thickness of the sheet bundle 5 is smaller than the reference value, the interlocking mechanism 111 changes the cutting position of the tape T so as to shorten the length L of the tape T to be cut by the cutter 56. For example, as the thickness of the sheet bundle 5 becomes thinner, the interlocking mechanism 111 changes the cutting position of the tape T so as to gradually shorten the length L of the tape T. A change relating to the cutting length of the tape T except for those described above is substantially the same as a change relating to the cutting length of the tape T according to the second modification example of the first embodiment.

In this manner, the cutting length changing unit 57 according to the embodiment described herein changes the cutting position of the tape T to be cut by the cutter 56, based on the information relating to the thickness of the sheet bundle 5, as the information relating to the sheet bundle 5. That is, in the embodiment described herein, the sheet binding device 1 includes the moving body 101 whose position is changed in accordance with the thickness of the sheet bundle 5 by coming into contact with the sheet bundle 5. The cutting length changing unit 57 has the interlocking mechanism 111 which mechanically interlocks the position of the moving body 101 with the relative position of the cutter 56 with respect to the tip end Te of the tape T. According to this configuration, it is possible to omit the drive source 73 of the movement mechanism 71. In this manner, it is possible to achieve miniaturization and cost reduction of the sheet binding device 1.

A specific configuration of the interlocking mechanism 111 is not limited to the above-described example. As long as a configuration is adopted so as to mechanically interlock the position of the moving body 101 of the detection unit D with the relative position of the cutter 56 with respect to the tip end Te of the tape T, any configuration may be adopted. The interlocking mechanism 111 according to the embodiment described herein moves the cutter 56, thereby changing the relative position of the cutter 56 with respect to the tip end Te of the tape T. Alternatively, the interlocking mechanism 111 may change the feeding length of the tape T fed to the cutter 56 fixed at the stationary position so as to change the relative position of the cutter 56 with respect to the tip end Te of the tape T.

Third Embodiment

Next, a third embodiment will be described. The embodiment described herein is different from the second embodiment in that the tape T is supplied due to its own weight, in that a different configuration of the detection unit D is adopted, and in that the tape holding unit 58 does not include the drive source 86 and the sheet binding device 1 is operated by being mechanically interlocked with the moving body of the detection unit D. The configurations other than the following are the same as those according to the second embodiment.

Figure 19:
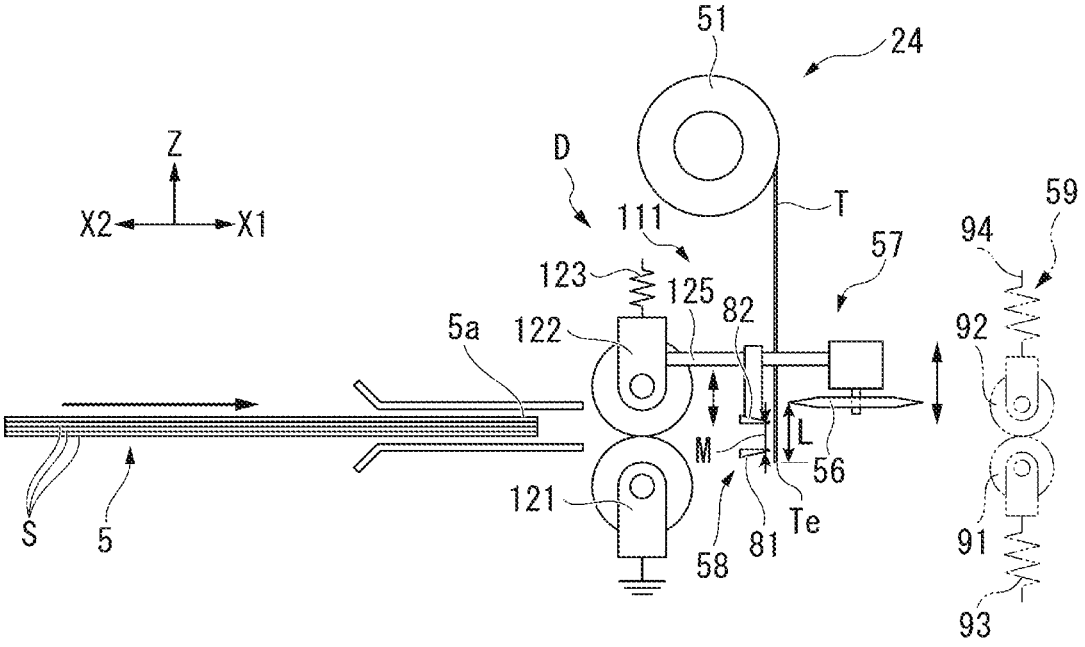
FIG. 19 is a front view illustrating an internal configuration of a sheet binding device according to a third embodiment.
Figure 20:
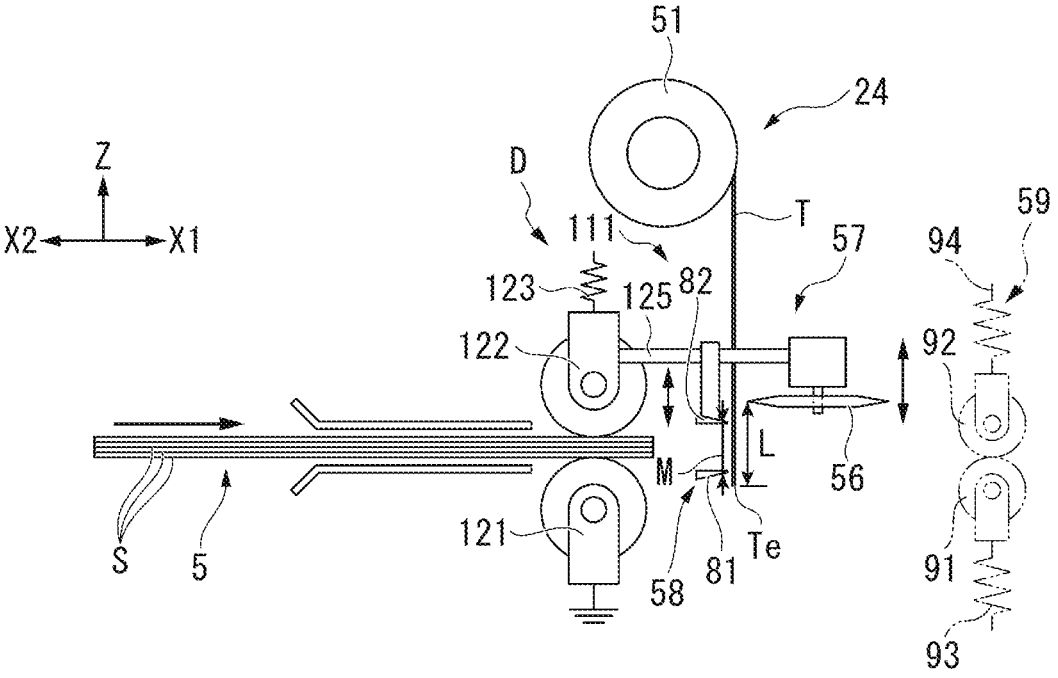
FIG. 20 is a front view illustrating an operation example of the sheet binding device illustrated in FIG. 19.

FIG. 19 is a front view illustrating an internal configuration of the sheet binding device 1 according to the embodiment described herein. FIG. 20 is a front view illustrating an operation example of the sheet binding device 1 illustrated in FIG. 19.

As illustrated in FIG. 19, the unwinding unit 51 according to the embodiment described herein supplies the tape T along a gravity direction. That is, the tape T is supplied by being fed downward due to its own weight.

The detection unit D according to the embodiment described herein includes a first roller 121, a second roller 122, and a spring 123. For example, the first roller 121 is fixed at the stationary position. The second roller 122 faces the first roller 121 in the sheet bundle thickness direction Z. The second roller 122 is movable in the direction approaching the first roller 121 and in the direction away from the first roller 121, in the sheet bundle thickness direction Z. The spring 123 biases the second roller 122 toward the first roller 121. As illustrated in FIG. 20, the sheet bundle 5 is inserted into a portion between the first roller 121 and the second roller 122. The second roller 122 comes into contact with the sheet bundle 5, thereby moving in the direction away from the first roller 121 in accordance with the thickness of the sheet bundle 5. The second roller 122 is an example of the "moving body" whose position is changed in accordance with the thickness of the sheet bundle 5.

In the embodiment described herein, the interlocking mechanism 111 of the cutting length changing unit 57 includes a connection member 125 which connects the second roller 122 and the cutter 56. The interlocking mechanism 111 mechanically interlocks the position of the second roller 122 and the relative position of the cutter 56 with respect to the tip end Te of the tape T. An operation relating to the movement of the cutter 56 according to the interlocking mechanism 111 in the embodiment described herein is substantially the same as an operation according to the interlocking mechanism 111 in the second embodiment.

In the embodiment described herein, the connection member 125 of the interlocking mechanism 111 of the cutting length changing unit 57 is also connected to the second holding member 82 of the tape holding unit 58. In this manner, the interlocking mechanism 111 of the cutting length changing unit 57 mechanically interlocks the position of the second roller 122 with the position of the second holding member 82. For example, the interlocking mechanism 111 interlocks the movement (movement amount) of the second roller 122 in the sheet bundle thickness direction Z with the movement (movement amount) of the second holding member 82 in the sheet bundle thickness direction Z. For example, when the thickness of the sheet bundle 5 is greater than the reference value, the interlocking mechanism 111 moves the second holding member 82 upward from the reference position in the sheet bundle thickness direction Z. In this manner, when the thickness of the sheet bundle 5 is greater than the reference value, the interlocking mechanism 111 lengthens the distance M between the first holding member 81 and the second holding member 82. A specific operation in which the interlocking mechanism 111 moves the second holding member 82 is substantially the same as an operation in which the interlocking mechanism 111 moves the cutter 56.

Similarly to the first embodiment, the sheet binding device 1 includes the tape attachment unit 59 which presses the tape T against the edge portion 5*a* of the sheet bundle 5. Instead of disposing the tape attachment unit 59, the first roller 121 and the second roller 122 of the detection unit D may press the tape T against the edge portion 5*a* of the sheet bundle 5.

In the above-described embodiment, similarly to the second embodiment, the sheet binding device 1 has the interlocking mechanism 111 which moves the relative position of the cutter 56 with respect to the tip end Te of the tape T in accordance with the thickness of the sheet bundle 5. According to this configuration, it is possible to omit the drive source 73 of the movement mechanism 71.

In the embodiment described herein, the interlocking mechanism 111 of the cutting length changing unit 57 mechanically interlocks the position of the second roller 122 with the position of the second holding member 82. According to this configuration, it is possible to omit the drive source 86 of the tape holding unit 58. In this manner, it is possible to further achieve miniaturization and cost reduction of the sheet binding device 1. A specific configuration of the interlocking mechanism 111 is not limited to the above-described example. As long as a configuration is adopted so as to mechanically interlock the position of the second roller 122 with the position of the second holding member 82, any configuration may be adopted. The interlocking mechanism which interlocks the position of the second roller 122 with the position of the cutter 56 may be arranged independent of the interlocking mechanism which interlocks the position of the second roller 122 and the position of the second holding member 82.

Figure 21:
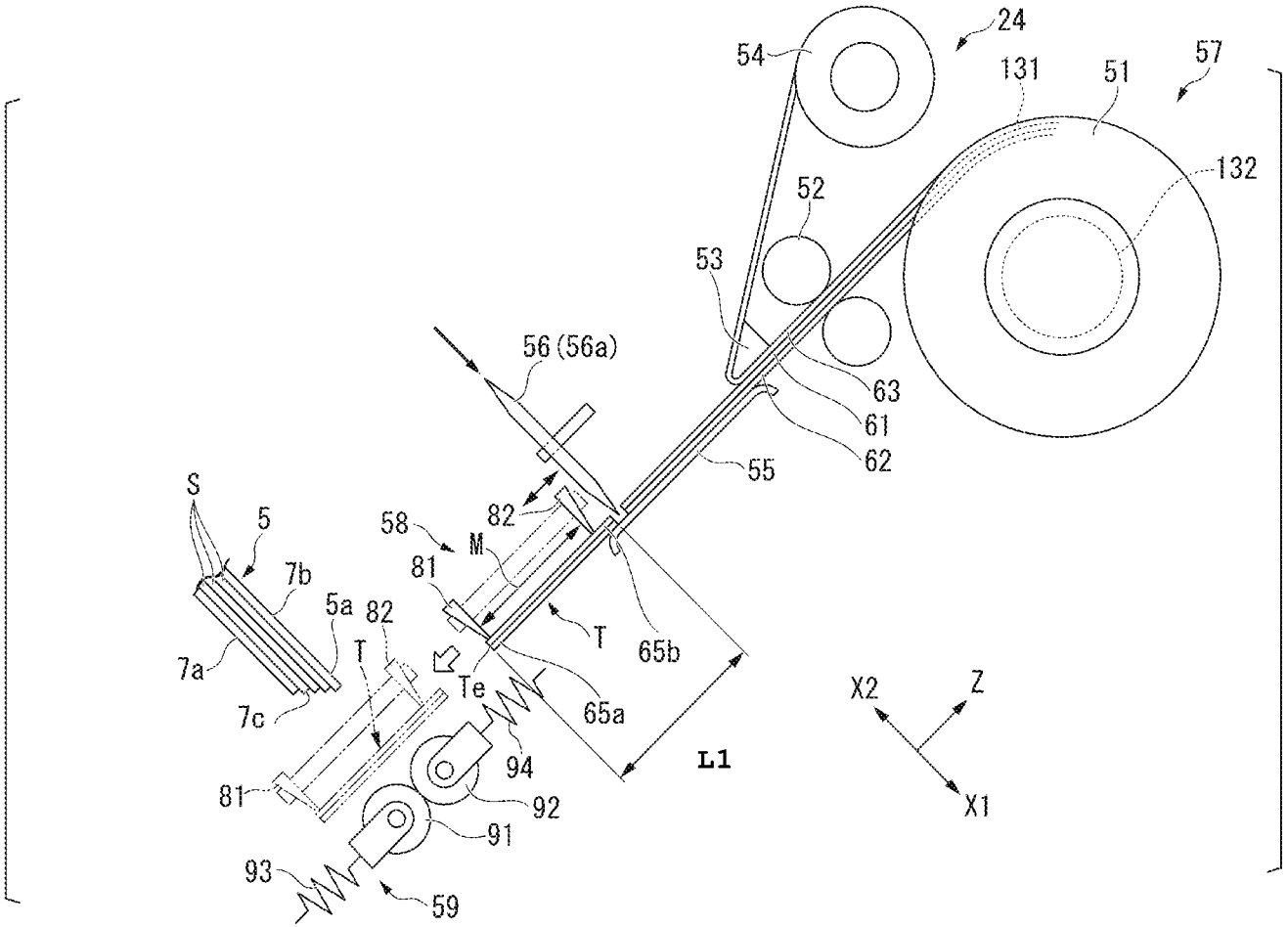
FIG. 21 illustrates a modification example of the sheet binding device according to the embodiments, in which a relatively large number of sheets form a sheet bundle.
Figure 22:
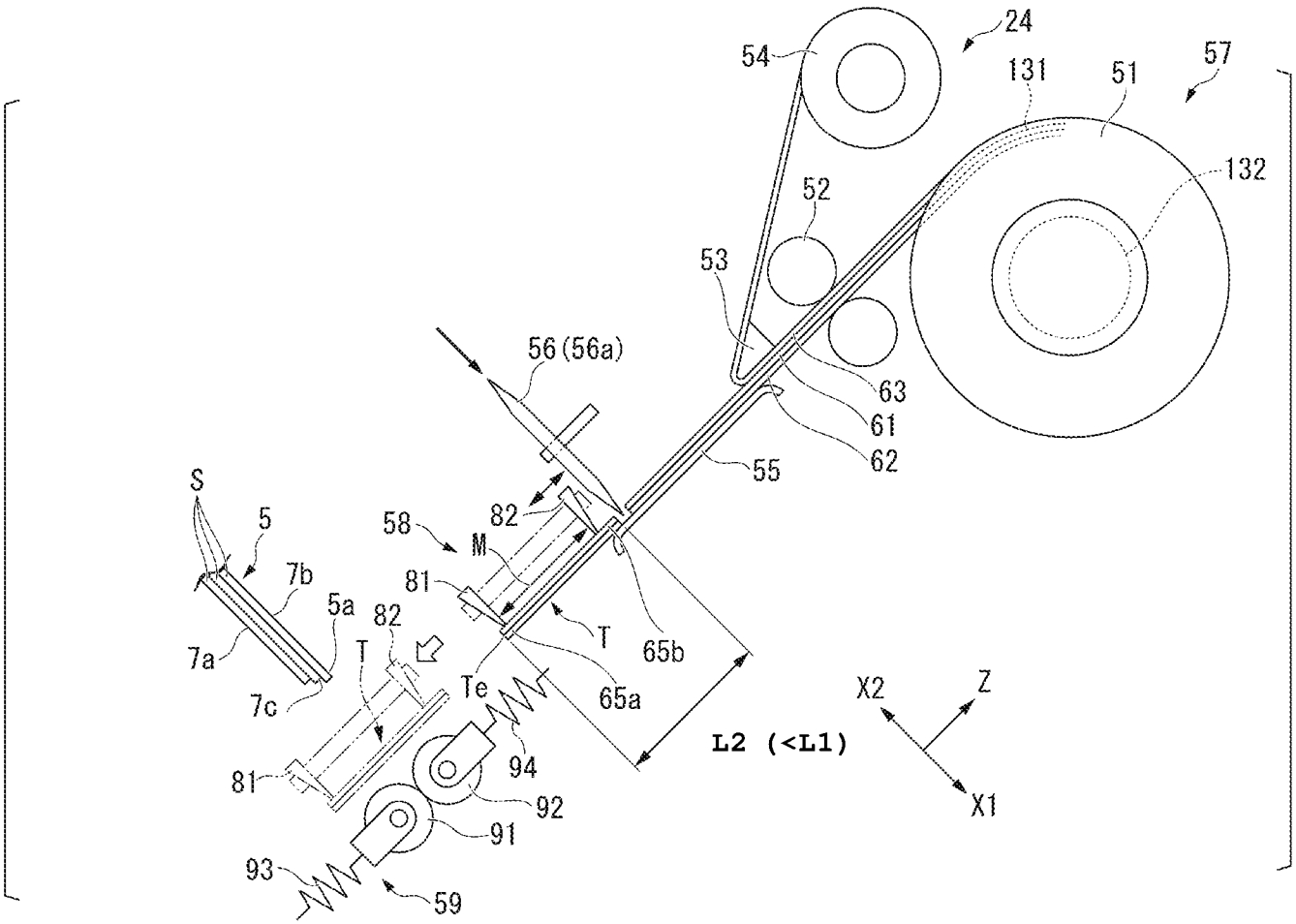
FIG. 22 illustrates a modification example of the sheet binding device according to the embodiments, in which a relatively small number of sheets form the sheet bundle.

Hitherto, the first to third embodiments have been described. However, configurations according to the embodiments are not limited to thee above-described examples. For example, instead of moving the position of the cutter 56, the cutting length changing unit 57 may change the feeding length of the tape T with respect to the cutter 56 fixed at the stationary position so as to change the cutting position of the tape T to be cut by the cutter 56. For example, FIG. 21 illustrates the sheet binding device 1 in a case of a relatively large number of sheets S forming the sheet bundle 5 (that is, when the sheet bundle 5 is thick). As illustrated in FIG. 21, the cutting length changing unit 57 includes a drive source 132 (for example, a motor) which rotates an original roll 131 accommodated in the unwinding unit 51. For example, the cutting length changing unit 57 increases a drive amount of the drive source 132 to be greater than the reference value, thereby increasing the feeding length (length of a portion extending over the cutter 56 when viewed from the unwinding unit 51) of the tape T with respect to the cutter 56. In this manner, the cutting length changing unit 57 lengthens the length L of the tape T to be cut by the cutter 56 to length L1. FIG. 22 illustrates the sheet binding device 1 in a case of a relatively small number of sheets S forming the sheet bundle 5 (that is, when the sheet bundle 5 is thin). As illustrated in FIG. 22, the cutting length changing unit 57 decreases the drive amount of the drive source 132 to be smaller than the reference value, thereby decreasing the feeding length of the tape T with respect to the cutter 56. In this manner, the cutting length changing unit 57 shortens the length L of the tape T to be cut by the cutter 56 to length L2 (<L1).

In the first embodiment, an example has been described in which the first roller 41 is actively rotated and the second roller 42 is passively rotated in the sheet shifting unit 23, but a configuration is not limited thereto. For example, both the first roller 41 and the second roller 42 may be rotated independently.

Figure 23:
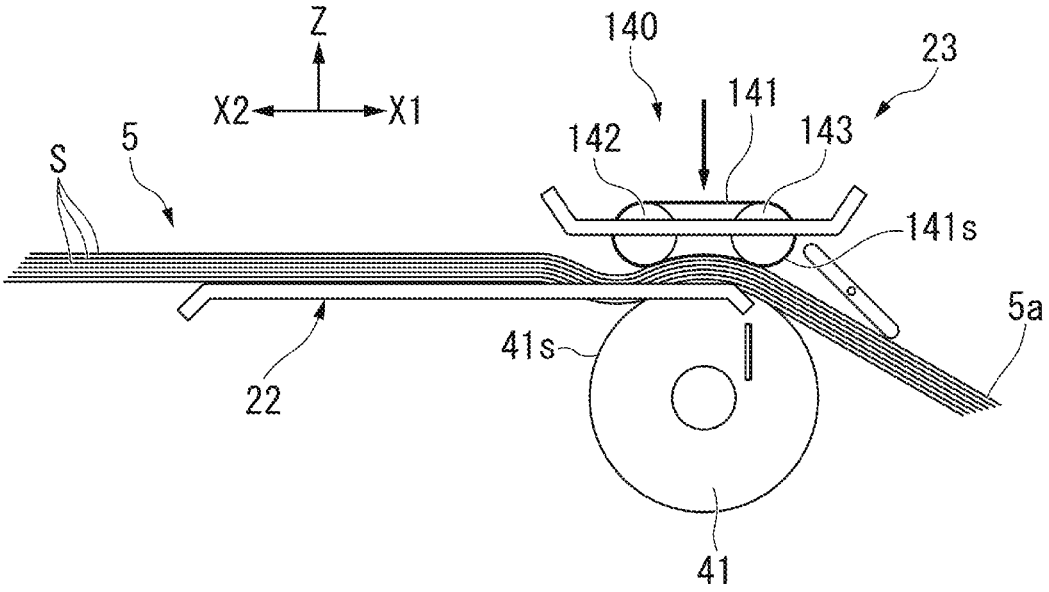
FIG. 23 is a front view illustrating a first modification example of a sheet shifting unit.

A configuration is not limited to a case where the sheet shifting unit 23 includes the first roller 41 and the second roller 42. For example, as illustrated in FIG. 23, the sheet shifting unit 23 may have a belt mechanism 140 instead of the second roller 42. The belt mechanism 140 is an example of a "second contact member". The belt mechanism 140 includes a belt 141, a first pulley 142, and a second pulley 143. The belt 141 turns around the first pulley 142 and the second pulley 143. If the belt mechanism 140 is moved toward the first roller 41, the sheet bundle 5 and an outer peripheral surface 141*s* of the belt 141 are deformed along the outer peripheral surface 41*s* of the first roller 41. In this state, the first roller 41 is rotated forward. In this manner, similarly to the first embodiment, the multiple sheets S are shifted in the edge portion 5*a* of the sheet bundle 5 in a stepwise manner.

Figure 24:
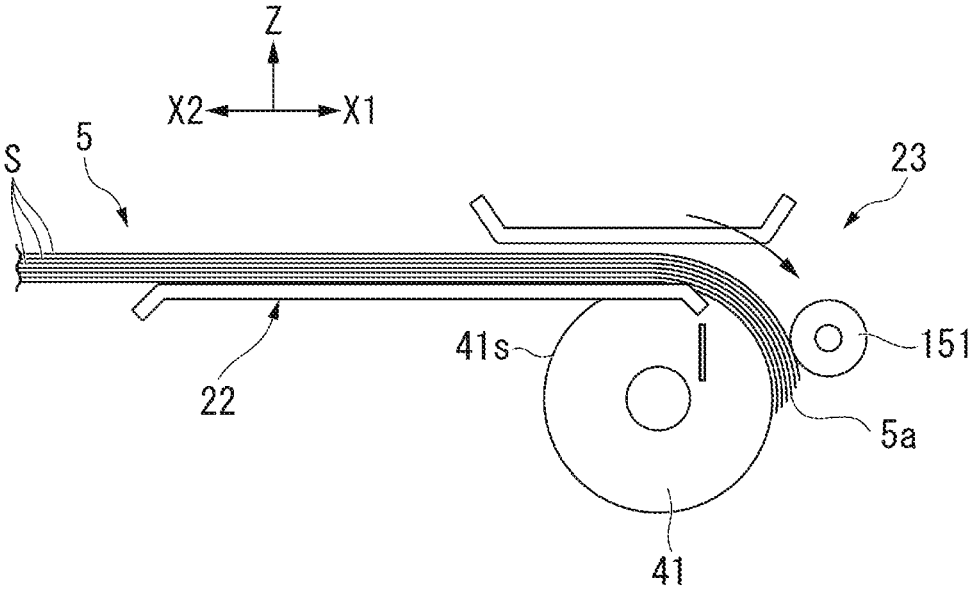
FIG. 24 is a front view illustrating a second modification example of the sheet shifting unit.

For example, as illustrated in FIG. 24, the sheet shifting unit 23 may include the first roller 41 and a second roller 151 which is smaller than the first roller 41. The second roller 151 is an example of the "second contact member". In a state where the sheet bundle 5 is interposed between the first roller 41 and the second roller 151, the second roller 151 moves along the outer peripheral surface 41*s* of the first roller 41. In this manner, the multiple sheets S are shifted in the edge portion 5*a* of the sheet bundle 5 in the stepwise manner.

In the first embodiment, an example has been described in which the first roller 91 and the second roller 92 in the tape attachment unit 59 are biased in the direction where both of these come into contact with each other, but a configuration is not limited thereto. For example, at least one of the first roller 91 and the second roller 92 may be biased where one comes into contact with the other.

In each of the first to third embodiments, the multiple sheets S may be aligned in the edge portion 5*a* of the sheet bundle 5 (refer to FIG. 19), or may be shifted in the edge portion 5*a* of the sheet bundle 5 in the stepwise manner (refer to FIGS. 4A and 4B).

According to at least any one embodiment described above, the sheet binding device 1 includes the cutting length changing unit which changes the length of the tape to be cut by the cutter, based on the information relating to the sheet bundle. According to this configuration, it is possible to reduce the number of replenished consumables or the cost required for the replenishment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A device for binding sheets comprising:

a guide;

a sheet shifting unit having a first roller and a second roller, outer peripheral surfaces of the first and second roller being positionable to convey a sheet bundle to be bound therebetween, wherein hardnesses of the outer peripheral surfaces of the first and second rollers are different, and the first and second rollers are configured to convey a plurality of sheets of the sheet bundle stacked on the guide such that edge portions of the plurality of sheets are shifted from each other in a sheet conveying direction by the sheet shifting unit; and a tape cutter configured to cut a tape with a target length that is varied in accordance with a thickness of the sheet bundle.

2. The device according to claim 1, further comprising:

a control unit configured to determine the thickness of the sheet bundle based on a number of sheets in the sheet bundle.

3. The device according to claim 2, further comprising:

an interface to an image forming apparatus, wherein data relating to the number of sheets is received by the control unit from the image forming apparatus through the interface.

4. The device according to claim 3, further comprising:

a cutting length changing unit configured to change a length of the tape to be cut by the tape cutter, based on data relating to the number of sheets which is received by the interface.

5. The device according to claim 4, further comprising:

a drive source that changes a relative position of the cutter with respect to a tip end of the tape, wherein the control unit is configured to control the drive source to change the length of the tape to be cut by the tape cutter, based on the data relating to the number of sheets which is acquired by the interface.

6. The device according to claim 3, further comprising:

a tape holding unit including a first holding member that holds a first end portion of the tape cut by the cutter, a second holding member that holds a second end portion of the tape cut by the cutter, while being movable to and from the first holding member, and a distance changing unit that changes a distance between the first holding member and the second holding member, wherein, in the tape holding unit, the distance changing unit changes the distance between the first holding member and the second holding member, based on the data relating to the number of sheets in the sheet bundle which is received by the interface.

7. The device according to claim 1, further comprising:

an interface to an image forming apparatus, wherein data relating to the thickness of sheets bundle is received from the image forming apparatus; and a control unit configured to change a length of the tape to be cut by the tape cutter, based on data relating to the thickness of sheets bundle which is received by the interface.

8. The device according to claim 7, further comprising:

a drive source that changes a relative position of the cutter with respect to a tip end of the tape, wherein the control unit is configured to control the drive source to change the length of the tape to be cut by the tape cutter.

9. The device according to claim 1, further comprising:

a moving body whose position is changed in accordance with a thickness of the sheet bundle by coming into contact with the sheet bundle; and an interlocking mechanism configured to mechanically interlock a position of the moving body with a relative position of the cutter with respect to a tip end of the tape.

10. The device according to claim 9, further comprising:

a tape holding unit including a first holding member that holds a first end portion of the tape cut by the cutter, and a second holding member that holds a second end portion of the tape cut by the cutter, while being movable to and from the first holding member, wherein the interlocking mechanism is configured to mechanically interlock the position of the moving body with a position of the second holding member.

11. A method for binding a plurality of sheets comprising:

stacking a plurality of sheets on a guide;

conveying the plurality of sheets with outer peripheral surfaces of a first roller and a second roller, wherein hardnesses of the outer peripheral surfaces of the first and second rollers are different, such that edge portions of the plurality of sheets are shifted from each other in a sheet conveying direction; and cutting a tape with a target length that is varied in accordance with a thickness of the plurality of sheets.

12. The method according to claim 11, wherein the thickness of the plurality of sheets is determined based on data relating to the number of the sheets.

13. The method according to claim 12, further comprising:

receiving the data relating to the number of sheets through an interface to an image forming apparatus.

14. The method according to claim 13, further comprising:

changing a length of the tape to be cut by a tape cutter, based on the data relating to the number of sheets which is received through the interface.

15. The method according to claim 14, further comprising:

changing a relative position of the cutter with respect to a tip end of the tape; and controlling a drive source to change the length of the tape to be cut by the tape cutter, based on the data relating to the number of sheets which is acquired through the interface.

16. The method according to claim 13, further comprising:

holding, by a first holding member, a first end portion of the tape cut by the cutter;

holding, by a second holding member, a second end portion of the tape cut by the cutter while being movable to and from the first holding member; and changing the distance between the first holding member and the second holding member, based on the data relating to the number of sheets which is received through the interface.

17. The method according to claim 11, further comprising:

receiving data relating to the number of sheets through an interface to an image forming apparatus;

determining the thickness of the plurality of sheets based on the data relating to the number of sheets by an interface; and changing a length of the tape to be cut by a tape cutter, based on data relating to the thickness of the plurality of sheets which is received by the interface.

18. The method according to claim 17, further comprising:

changing a relative position of the tape cutter with respect to a tip end of the tape; and controlling a drive source to change the length of the tape to be cut by the tape cutter.

19. The method according to claim 11, further comprising:

changing a position of a moving body in accordance with a thickness of the plurality of sheets by the moving body coming into contact with the sheet bundle; and mechanically interlocking a position of the moving body with a relative position of the tape cutter with respect to a tip end of the tape.

20. The method according to claim 19, further comprising:

holding, by a first holding member, a first end portion of the tape cut by the cutter;

holding, by a second holding member, a second end portion of the tape cut by the cutter while being movable to and from the first holding member; and mechanically interlocking the position of the moving body with a position of the second holding member.

* * * * *